US008714785B2

(12) United States Patent
Osada et al.

(10) Patent No.: US 8,714,785 B2
(45) Date of Patent: May 6, 2014

(54) CAP, SOCKET DEVICE, AND LUMINAIRE

(75) Inventors: Takeshi Osada, Kanagawa-ken (JP); Satoshi Watanabe, Kanagawa-ken (JP); Keiichi Shimizu, Kanagawa-ken (JP); Shigeru Osawa, Kanagawa-ken (JP); Kenji Nezu, Kanagawa-ken (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 0 days.

(21) Appl. No.: 13/497,032

(22) PCT Filed: Jul. 5, 2011

(86) PCT No.: PCT/JP2011/065346

§ 371 (c)(1),
(2), (4) Date: Apr. 26, 2013

(87) PCT Pub. No.: WO2012/005239

PCT Pub. Date: Jan. 12, 2012

(65) Prior Publication Data

US 2013/0201697 A1 Aug. 8, 2013

(30) Foreign Application Priority Data

Jul. 5, 2010 (JP) ..... P2010-152992

(51) Int. Cl.

| | |
|---|---|
| ***F21V 19/00*** | (2006.01) |
| ***F21S 2/00*** | (2006.01) |
| ***F21V 23/00*** | (2006.01) |
| ***F21V 29/00*** | (2006.01) |

(52) U.S. Cl.
USPC ..... 362/373; 362/241; 362/297; 362/249.02; 362/276

(58) Field of Classification Search
None
See application file for complete search history.

(56) References Cited

U.S. PATENT DOCUMENTS

| | | | | |
|---|---|---|---|---|
| 7,722,213 | B2 * | 5/2010 | Inoue et al. | 362/241 |
| 2005/0231963 | A1 | 10/2005 | Isoda et al. | |
| 2011/0261572 | A1 * | 10/2011 | Watanabe et al. | 362/373 |

FOREIGN PATENT DOCUMENTS

| | | |
|---|---|---|
| JP | 2005-310393 | 11/2005 |
| JP | 2006-120427 | 5/2006 |
| JP | 2009-199844 | 9/2009 |
| JP | 2010-129488 | 6/2010 |

OTHER PUBLICATIONS

International Search Report and Written Opinion for application No. PCT/JP2011/065346 dated Oct. 25, 2011 (9 pages).

* cited by examiner

*Primary Examiner* — Ashok Patel
(74) *Attorney, Agent, or Firm* — Patterson & Sheridan, LLP

(57) ABSTRACT

Provided are a cap, a socket device, and a luminary which reduce the influence of noise. A lamp with the cap includes a lamp main body having engaging means mounted so as to be attachable to and detachable from a socket device; a light emitting-portion; a control device that controls the light-emitting portion; a cap member for a power source situated adjacent to one side with the engaging means interposed therebetween is disposed in a circular track of the lamp main body and connected to the control device; a cap member for signaling situated adjacent to the other side with the engaging means interposed therebetween is disposed in the circular track of the lamp main body and connected to the control device; and a thermal conductor that comes into contact with a thermal radiator when mounted on the socket device.

16 Claims, 15 Drawing Sheets

CAP, SOCKET DEVICE, AND LUMINAIRE

TECHNICAL FIELD

An embodiment of the present invention relates to a lamp with a cap, a socket device, and a luminaire capable of handling the control of dimming or the like.

BACKGROUND ART

In the related art, compact fluorescent lamps having a flat, thin structure suitable for narrow spaces, such as lighting for showcases or under-shelf lights, have been used. In recent years, in place of the fluorescent lamps, an LED lamp with a cap having a flat, thin structure, which adopts a light-emitting diode, which is a solid state light-emitting device having a long life and low power consumption, as a light source, has been suggested.

CITATION LIST

Patent Literature

[PTL 1] JP-A-2010-129488

SUMMARY OF INVENTION

Technical Problem

This kind of LED lamp generally has a GX53 type cap and is mounted so as to be attachable to and detachable from a socket device capable of connecting the cap, thus configuring a luminaire. Meanwhile, in this kind of LED lamp, there is a demand for a lamp with a cap and a socket device capable of handling the control of the dimming or the like. In order to stably perform such control, there is a problem regarding how to configure the lamp so that the signal line is not easily influenced by noise from a power source line connected to the socket device. In addition, at the same time, there is a problem regarding how to simplify the wiring of the power source line and the signal line so as not to obstruct the miniaturization of the lamp, the socket device and the luminaire.

The present invention has been made in view of the above problems, and an object thereof is to provide a lamp with a cap, a socket device, and a luminaire which reduce the influence of noise.

Solution to Problem

A lamp with a cap in an embodiment of the present invention includes a lamp main body which has engaging means mounted so as to be attachable to and detachable from a socket device, and a light-emitting portion is accommodated in the lamp main body. A control device, which lights and controls the light-emitting portion, is accommodated in the lamp main body. A cap member for a power source to be connected to the control device is situated to be adjacent to one side with the engaging means interposed therebetween, and is disposed on a circular track on the lamp main body. A cap member for signaling connected to the control device is situated to be adjacent to the other side with the engaging means interposed therebetween, and is disposed in the circumferential direction of the lamp main body. Moreover, the lamp with the cap includes a thermal conductor which comes into contact with a thermal radiator in the state of being mounted on the socket device.

Furthermore, a socket device in another embodiment of the present invention includes a socket main body having engaging means on which the lamp with the cap is mounted in an attachable and detachable manner. A terminal member for a power source, to which the cap member for the power source of the lamp with the cap is connected, is situated to be adjacent to one side with the engaging means interposed therebetween, and is disposed in the circumferential direction of the socket main body. A terminal member for signaling, to which the cap member for signaling of the lamp with the cap is connected, is situated to be adjacent to the other side with the engaging means interposed therebetween, and is disposed on a circular track of the socket main body.

Advantageous Effects of Invention

According to an embodiment of the present invention, it is possible to provide a lamp with a cap, a socket device and a luminaire which reduce the influence of noise.

DESCRIPTION OF EMBODIMENTS

Figure 1A:
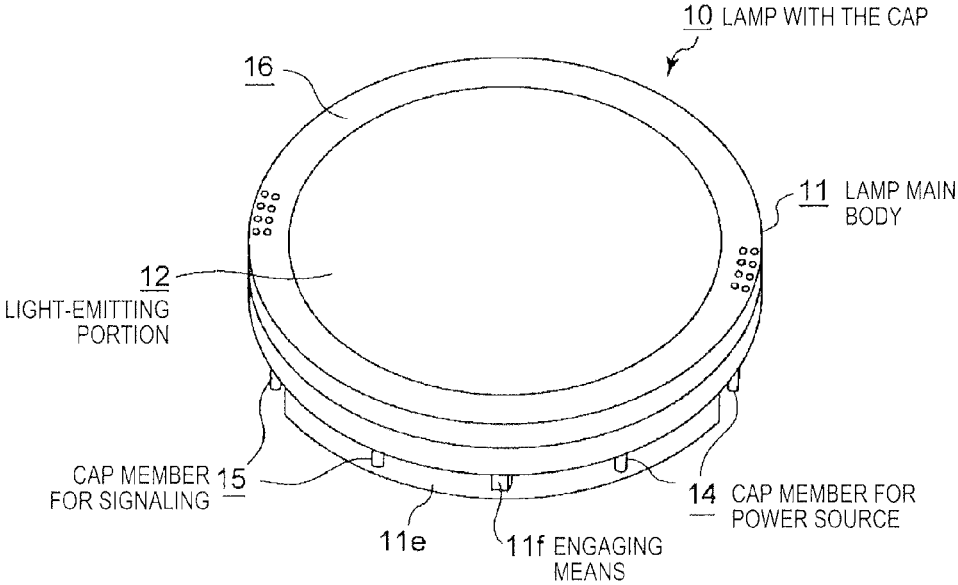
FIG. 1 show a lamp with a cap which is an embodiment of the present invention, FIG. 1(*a*) is a perspective view, FIG. 1(*b*) is a cross-sectional perspective view which is cut along the line b-b of FIG. 2, and FIG. 1(*c*) is a cross-sectional view that shows a cap member for signaling in a withdrawn state.

Hereinafter, embodiments of a lamp with a cap, a socket device, and a luminaire will be described.

Embodiment 1

Firstly, a configuration of the lamp with the cap will be described. The lamp with the cap of the present embodiment constitutes a lamp with a cap 10 of a flat thin structure provided with a pin-shaped cap member, and, as shown in FIGS. 1 to 4, includes a lamp main body 11 which has engaging means 11*f* mounted on a socket device by a rotation operation in an attachable and detachable manner, a light-emitting portion 12 which is accommodated in the lamp main body, a control device 13 which is accommodated in the lamp main body and lights and controls the light-emitting portion, a cap member for power source 14 which is situated adjacent to one side with the engaging means interposed therebetween, is disposed in the circumferential direction of the lamp main body, and is connected to the control device 13, and a cap member for signaling 15 which is situated adjacent to the other side with the engaging means interposed therebetween, is disposed in the circumferential direction of the lamp main body and is connected to the control device 13.

The lamp main body 11 forms a dish shape which has a plane shape having a transverse cross-section of a substantial circular shape and is formed of a metal having satisfactory thermal conductivity, in the present embodiment, aluminum, so as to increase the thermal radiation properties. The opening portion 11*a* of one end portion side is integrally formed with a substrate support portion 11*b* forming a circular concave step portion. The substrate support portion is formed so that the bottom surface of the concave step portion is a flat surface, and a convex portion 11*c* forming a ring shape is integrally formed around the substrate support portion. Furthermore, the other end portion side of the lamp main body 11 is integrally formed with a cylindrical protrusion portion 11*e* in which an inner portion thereof is a concave fitting portion so that an annular support step portion 11*d* is formed on an outer bottom surface. A thermal conduction surface 11*g* as a thermal conductor in the present invention formed on the outer bottom surface of the protrusion portion 11*e* is formed on the flat surface so as to thermally adhere to and support the thermal radiator 34 of the luminaire side. As a result, the lamp main body 11 is projected from a middle portion surrounded by the cap member for power source 14 and the cap member 15 for signaling described later and has a protrusion portion 11*e* mounted on the socket device 21, and the thermal radiator 34 of the luminaire side comes into surface-contact with the protrusion portion 11*e* mounted on the socket device 21.

Furthermore, the protrusion size of the protrusion portion 11*e* is formed to be greater than a hole depth size of a support hole 21*a* of the socket main body 21 described later, and when mounting the lamp main body 11 to the socket main body 21, the thermal conduction surface 11*g* of the end surface of the protrusion 11*e* is configured so as to be projected from the support hole 21*a*. In addition, by interposing a thermal transmission sheet such as a silicone resin on the plane of the thermal conduction surface 11*g* of the end surface of the protrusion portion 11*e* so as to effectively conduct heat from the LED, the thermal radiation effect can be further increased.

Engaging means 11*f* is formed on the outer peripheral surface of the protrusion portion 11*e*. The engaging means is means for being mounted on engaging means 21*a*1 provided in the socket device 20 described later in an attachable and detachable manner, and is formed by integrally projecting the engaging means of the lamp with the cap 10 to the outer peripheral surface of the protrusion portion 11*e*, in the present embodiment (hereinafter, the engaging means 11*f* of the lamp with the cap is called an "engaging protrusion 11*f*").

Figure 3:
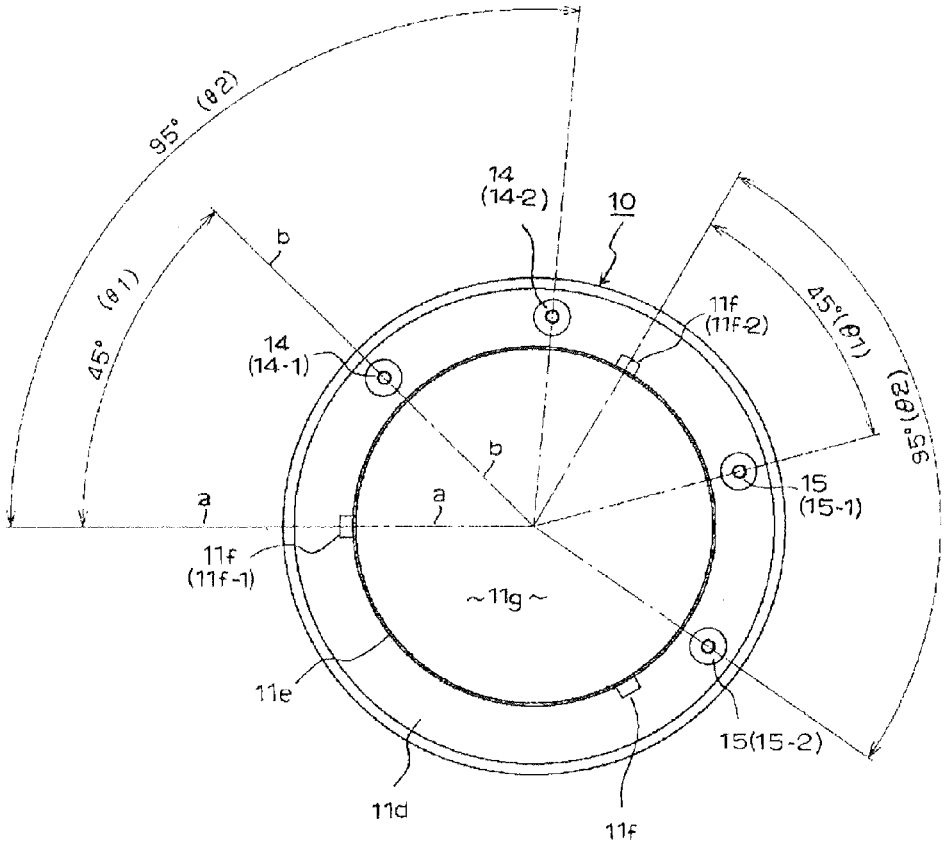
FIG. 3 is a bottom view of the lamp with the cap.

As shown in FIG. 3, three engaging protrusions 11*f* are formed to have uniform intervals with respect to the outer peripheral surface in the protrusion portion 11*e* at an angle of 120° from the center o of the lamp main body 11 in a diametrical direction, and the respective engaging protrusions 11*f* form the same shape forming a substantially square shape. The lamp main body 11 of the configuration is processed by, for example, the casting, the forging, the cutting process or the like. In the present embodiment, the lamp main body is formed by the aluminum die casting.

The light-emitting portion 12 includes the solid state light-emitting device 12*a* and the substrate 12*b* with the solid state light-emitting device 12*a* mounted thereon. The solid state light-emitting device is constituted by a light-emitting diode (hereinafter, referred to as a "LED 12*a*") in the present embodiment, and includes a plurality of, in the present embodiment, six SMD type LEDs. In addition, the LED may be a so-called COB form of a type which emits white (including a neutral white, a daylight color, and a bulb color) by a plurality of LED chips and a phosphor excited by the LED chips.

Figure 1B:
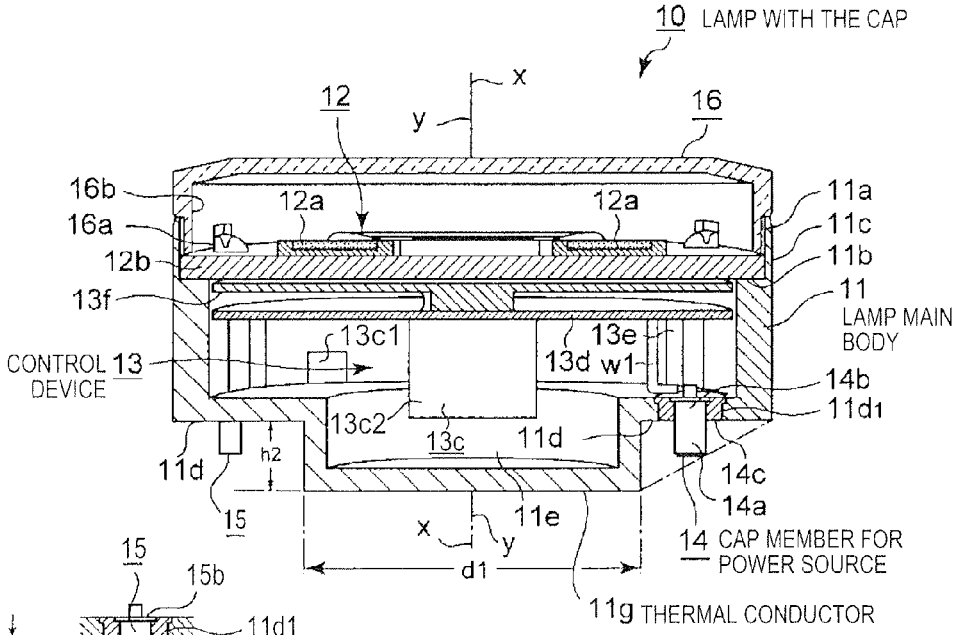
Figure 1C:
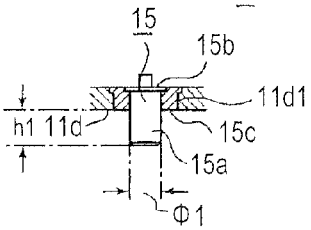
Figure 2:
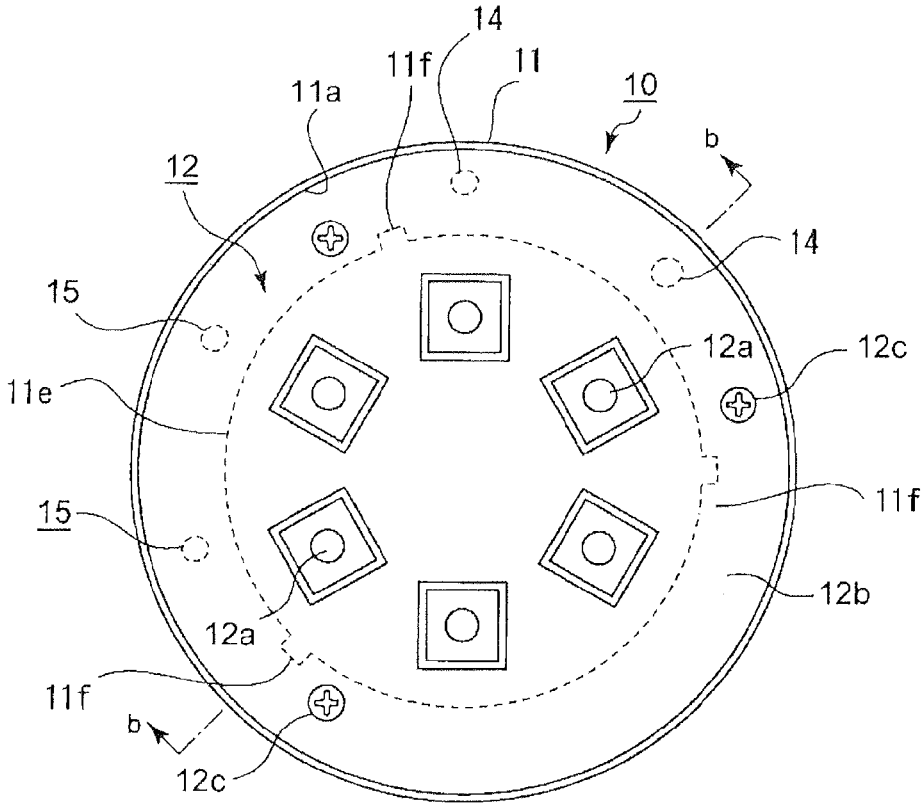
FIG. 2 is a top view that shows the lamp with the cap in a state where the cover member is detached.

The substrate 12*b* is formed of a metal having satisfactory thermal conductivity, in the present embodiment, aluminum forming a thin circular plate shape of a flat plate shape, the surface thereof (an upper surface in FIG. 1(*b*)) is formed with a wiring pattern formed of a copper foil via an electric insulation layer such as silicone resin, and the respective six LEDs 12*a* are disposed and mounted on the wiring pattern so as to form a substantially concentric circular shape at substantially equal intervals (FIG. 2). As a result, the light-emitting portion 12 is constituted by the light-emitting module in which six LEDs 12*a* are disposed on the substrate 12*b* forming the circular plate shape so as to be substantially point-symmetric to the center of the circular substrate.

The light-emitting portion 12 configured as above draws the electric insulation in the substrate support portion 11*b* formed on one end portion side of the main body 11, is disposed so as to adhere thereto, and adhere to and is fixed to the bottom surface of the substrate support portion 11*b* forming the flat surface via the electric insulation sheet or the like (not shown) formed of the silicone resin or the like as necessary using the fixing means 12*c* such as a screw.

As a result, the light-emitting portion 12 is accommodated on one end portion side of the lamp main body 11, the back of the substrate 12*b* reliably adheres to the substrate support portion 11*b* of the lamp main body 11, and the substrate 12*b* is formed of aluminum having satisfactory thermal conductivity, whereby it is possible to effectively transmit and radiate heat generated from the LED 12*a* to the lamp main body 11 formed of aluminum. With such configurations, an optical axis y-y of the light-emitting portion 12 constituted by the substrate 12*b* with the six LEDs 12*a* mounted thereon substantially mates with the center axis x-x of the lamp main body 11, and the light source portion having a substantially circular light-emitting surface when viewed from the upper surface as a whole is constituted.

Figure 4:
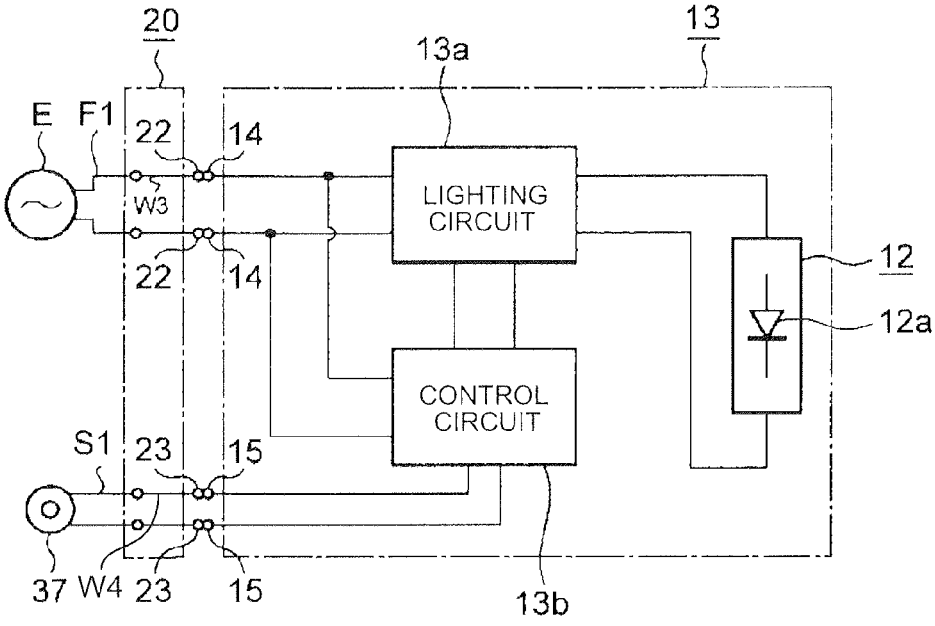
FIG. 4 is a circuit block diagram of a control device in the lamp with the cap.

As shown in the circuit block diagram of FIG. 4, the control device 13 includes a lighting circuit 13*a* which converts the alternating current voltage 100V into the direct current voltage 24V to supply the direct current of the constant electric current to the LED 12*a*, and a control circuit 13*b* which performs the lighting, the light-out, the dimming, the toning or the like of the light-emitting portion 12 by the control signal from the outside, in the present embodiment, the lighting, the light-out, and the dimming. As shown in FIG. 1(*b*), the electronic component 13*c* constituting the lighting circuit 13*a* and the control circuit 13*b* is mounted on the circuit board 13*d* made of a circular flat plate-shaped glass epoxy. The circuit board 13*d* is formed with the circuit pattern on one surface or both surfaces thereof, a plurality of small electronic components 13*c* is mounted on the mounting surface thereof, and the circuit board 13*d* is accommodated in the lamp main body 11.

In addition, in the present embodiment, the electronic component 13*c* is accommodated in the lamp main body 11 as below. That is, the component involving the heating, for example, a switching transistor 13*c*1 is separated from the circuit board 13*d* by the lead wire, and is accommodated in the inner bottom surface of the lamp main body 11 in the adhering state. Furthermore, a relatively large lead component, for example, a current transformer 13*c*2 is accommodated in a concave fitting portion formed by the protrusion portion 11*e* of the lamp main body. As a result, heat of the switching transistor 13*c*1 involving the heating is radiated from the lamp main body 11 formed of aluminum to the outside, and the temperature rise is suppressed. Simultaneously, the large component is accommodated in the protrusion portion 11*e*, that is, in the concave fitting portion, thereby forming the flat and thin type structure of the lamp main body 11.

The circuit board 13*d* configured as mentioned above is disposed and supported in the lamp main body 11 via a support leg 13*e* made of a synthetic resin having thermal resistance and electric insulation properties, in the present embodiment, made of a PBT (polybutylene terephthalate) so that a predetermined gap is formed from the lower part of the substrate 12*b* of the light-emitting portion 12 and the inner bottom surface of the lamp main body. In FIG. 1(*b*), reference numeral 13*f* is a heat shielding plate which has thermal resistance and electric insulation properties such as PBT and is formed in a circular plate shape formed of a synthetic resin having thermal insulation properties, is supported so as to have a gap on the upper center portion of the circuit board 13*d*, and blocks the mutual thermal influence between the substrate 12*b* and the circuit board 13*d* by being interposed between the substrate 12*b* of the light-emitting portion 12 and the circuit board 13*d*. In addition, the output terminal of the circuit substrate 13*d* constituting the control device 13 and the input terminal of the substrate 12*b* of the light-emitting portion 12 are connected by the lead wire (not shown).

Furthermore, the lighting circuit 13*a* and the control circuit 13*b* are configured as shown in the circuit block diagram of FIG. 4. That is, the lighting circuit 13*a* is constituted by an AC/DC converter, a rectifier circuit, a constant current supply circuit or the like, converts the alternating current voltage 100V of the commercial power source E into the direct current voltage 24V and supplies the direct current of the constant current to the respective LEDs 12*a*. The control circuit 13*b* which is constituted by a microcomputer or the like, generates the control signal for performing the lighting, the light-out, and the dimming based on the control signal transmitted from the outside, and supplies the same to the lighting circuit 13*a*. The lighting circuit 13*a* controls the lighting so as to perform the lighting, the light-out, and the dimming of the LED 12*a* of the light-emitting portion 12 based on the control signal. In addition, the control signal transmitted from the outside is transmitted to the control circuit 13*b* via the signal line S1 through the operation of the dimmer 37 for existing incandescent lamp placed on a wall surface or the like of a house by a user in the present embodiment. In FIG. 4, reference numeral 14 is a cap member for a power source for being connected to the commercial power source via the socket device 20, and reference numeral 15 is a cap member for signaling for inputting the control signal via the socket device 20.

Furthermore, the control device 13 in the present embodiment has the cap member for signaling 15 for inputting the control signal from the dimmer 37 of the outside to the input side of the control circuit 13*b*. However, the lighting circuit 13*a* and the control circuit 13*b* are connected to the power source in parallel, and can be operated even if the signal line is not connected to the cap member for signaling 15. For this reason, when the dimmer 37 is not installed, the device can be operated as a normal lamp with the cap having no dimming function.

As shown in FIG. 1(*b*), the cap member 14 for power source is formed of a metal such as a copper, a brass or the like having electric conductivity, in the present invention, the brass, and is constituted by a pair of pin-shaped cap pins having a cylindrical shaft portion 14*a* and a disk-shaped based portion 14*b*. The cap member for power source 14 is integrally embedded and supported in the support substrate 14*c* formed in the disk shape formed of a synthetic resin having thermal resistance and electric insulation properties such as PBT by the resin molding. A pair of two support substrates 14*c* integrally embedded with the cap member for power source 14 are provided, are fitted to a pair of circular support holes 11*d*1 formed adjacent to one side of the engaging protrusion 11*f* in the annular support step portion 11*d* of the lamp main body 11, respectively, and are fixed by an adhesive formed of a silicone resin, an epoxy resin or the like.

As a result, as shown in FIG. 3, the pair of cap members for power source 14-1 and 14-2 is situated adjacent to the engaging protrusion 11*f*-2 of the lamp with the cap 10, that is, the one side with the engaging means interposed therebetween, and is disposed on the circular track of the lamp main body 11. Moreover, the pair of cylindrical shaft ports 14*a* of the cap member for power source 14 is provided so as to be projected outward from the outer bottom surface of the lamp main body 11, and the respective base portions 14*b* are electrically connected by the control device 13 and the lead wire w1. In addition, according to the cap member for power source 14 of the present embodiment, the tip portion of the pin-shaped shaft portion 14*a* is not projected from the lamp main body 11 as shown by an alternate long and short dash line in FIG. 1(*b*), and thus the risk that the cap pin is deformed by an external shock due to the dropping or the like is reduced, and it is possible to reduce the mounting disadvantage of the lamp with the cap with respect to the socket device due to cap deformation. In addition, in the present configuration, the cap member for signaling 15 described later is also similarly configured, the mounting disadvantage can be reduced.

As shown in FIG. 1(*c*), the cap member 15 for signaling is formed of a metal such as a copper, a brass or the like having electric conductivity having the same shape and size as those of the cap member 14 for power source, in the present embodiment, the brass, and is constituted by a pair of pin-shaped cap pins having the circular shaft portion 15*a* and the disk-shaped base portion 15*b*. The cap member for signaling 15 is supported in the support substrate 15*c* formed in the disk shape by a synthetic resin having thermal resistance and electric insulation properties such as the PBT by being integrally embedded by the resin molding. A pair of two support substrates 15 with the cap member for signaling 15 integrally embedded is prepared, is fitted to the pair of circular support holes 11*d*1 formed adjacent to the other side of the engaging protrusion 11*f* in the annular support step portion 11*d* of the lamp main body 11, respectively, and is fixed by an adhesive formed of a silicone resin, an epoxy resin or the like.

As a result, as shown in FIG. 3, the pair of cap members for signaling 15-1 and 15-2 is situated adjacent to the engaging protrusion 11*f*-2 of the lamp with the cap 10, that is, the other side with the engaging means interposed therebetween, and is disposed on the circular track of the lamp main body 11. Furthermore, the circular track, in which the cap member for signaling 15 is disposed, is disposed on the trace of the same circle as the circular track of the cap member for power source 14, and is configured so as not disturb the reduction in size. In addition, the cap member for signaling 15 may be disposed on the different circular track in the range not disturbing the reduction in size. Moreover, the pair of cylindrical shaft portions 15*a* of the cap member for signaling 15 is provided so as to be projected outward from the outer bottom surface of the lamp main body 11, and the respective base portions 15*b* are electrically connected by the control device 13 and the lead wire (not shown).

As mentioned above, as mentioned in FIG. 3, the cap member for power source 14 and the cap member for signaling 15 are separated from each other in both side directions of the engaging protrusion 11*f*-2 by a predetermined size with the engaging protrusion 11*f*-2 (the engaging means) interposed therebetween, are situated adjacent to each other, and are placed on the circular track of the lamp main body 11. As a result, the lead wire w1 connecting the cap member for power source 14 with the control device 13 and the lead wiring connecting the cap member for signaling 15 with the control device 13 can be performed in one location so as to be focused in both sides of the engaging protrusion 11*f*-1, it is possible to simplify the wiring of the power source line and the signal line, and a reduction in size of the lamp with the cap 10 can be achieved.

When the cap member for power source 14 and the cap member for signaling 15 are situated so as to face each other in the diametrical direction, there is a need to perform the wiring of each electric line in a position separated in the diametrical direction, there is a need to draw each electric line in the lamp main body 11, and thus, there is a need for a space for drawing. For this reason, the wiring operation is complicated, and it is difficult to achieve a reduction in size of the lamp main body.

Furthermore, at the same time, the cap member for power source 14 and the cap member for signaling 15 are situated so as to be separated from each other on both sides of the engaging protrusion 11*f*-2 by a predetermined size with the engaging protrusion 11*f*-2 interposed therebetween, and thus the lead wire for signaling and the cap member 15 make it difficult to pickup the noise easily generated from the lead wire for power source and the cap member 14.

The angle dimensions of the cap member for power source 14, the cap member for signaling 15 and three engaging protrusions 11*f* in the present embodiment, that is, the angle dimension of the lamp with cap 10 side is disposed as below. That is, as shown in the bottom view of the lamp with the cap 10 of FIG. 3, when showing the angle facing the diametrical direction from the center o starting from two engaging protrusions 11*f*-1 and engaging protrusion 11*f*-2 in the engaging protrusion 11*f* formed to have the uniform gap at an angle of 120°, an angle θ1 facing the diametrical direction of one cap member for power source 14-1 adjacent to the engaging protrusion 11*f*-1 is 45°, and an angle θ2 facing the diametrical direction of the other (the other side separated from the engaging protrusion 11*f*-1) cap member for power source 14-2 is 95°.

Furthermore, the angle θ1 facing the diametrical direction of one cap member for signaling 15-1 adjacent to the engaging protrusion 11*f*-2 is 45°, and the angle θ2 formed in the diametrical direction of the other (the other side separated from the engaging protrusion 11*f*-2) cap member for signaling 15-2 is 95°.

In addition, the respective angles θ1 and θ2 are angles formed between the line a-a passing through the center axis of the respective engaging protrusion 11*f* and the line b-b passing through the shaft centers of the respective shaft portions 14*a* and 15*a* forming the cylindrical shape of the cap member for power source 14 and the cap member for signaling 15. Furthermore, a rotation angle α1 of the lamp with the cap 10 relative to the socket device 20 is 15°. In addition, a diameter ϕ1 of the shaft portions 14*a* and 15*a* forming the cylindrical shape is about 2.5 mm, a protrusion size h1 from the support step portion 11*d* of the lamp main body 11 is about 6 mm, an outer diameter d1 of the concave fitting portion 11*e* is about 65 mm. The angle and the size mentioned above are allowed within the range of the manufacturing error. In addition, as mentioned above, the position relationship between the pair of cap member for power sources 14 and the pair of cap members for signalling 15 may be reversed.

Next, as shown in FIG. 1, the cover member 16 constitutes the globe of the lamp, and thus, is formed of a transparent member having light-transmitting properties or a translucent member having optical distribution properties, in the present embodiment, the milky white glass, and is formed in the flat curved surface shape having the opening portion 16*a* at one end portion side thereof. The edge portion surrounding the opening portion 16*a* is a cylindrical side wall portion 16*b*, and the front facing the opening portion is formed in the smooth curved surface shape. The cover member 16 configured as above faces so as to cover the light-emitting portion 12 of the lamp main body 11, the opening portion 16*a* is fitted so as to have a predetermined overlap value in the inner surface of the convex portion 11*c* of one end portion side of the lamp main body 11, and is fixed by an adhesive such as a silicone resin and an epoxy resin. As mentioned above, the cover member 16 and the light-emitting portion 12 having the LED 12*a* are provided on one end portions side of the lamp main body 11, and the lamp with the cap 10 of the flat thin type structure provided with the pin-shaped cap member for power source 14 and the cap member for signaling 15 on the other end portion side is constituted.

Next, a configuration of the socket device will be described. The socket device of the present embodiment is electrically connected to the pin-shaped cap member for power source 14 and the cap member for signaling 15 of the lamp with the cap 10, thereby constituting the socket device incorporated into the luminaire 30. Thus, as shown in FIGS. 5 to 10, the socket device includes a socket main body 21 having engaging means 21*a*1 in which the lamp with the cap 10 is mounted by the rotation operation in an attachable and detachable manner, a terminal member for power source 22 which is situated adjacent to one side with the engaging means interposed therebetween and is disposed on the circular track of the socket main body 21 and to which the cap member for power source 14 of the lamp with the cap 10 is connected, and a terminal member for signaling 23 which is situated adjacent to the other side with the engaging means interposed therebetween and is disposed on the circular track of the socket main body 21 and to which the cap member for signaling 15 of the lamp with the cap 10 is connected.

The socket main body 21 is formed in a ring shape having a penetrated support hole 21*a* in the middle portion which has a substantially circular shape of a plane shape of a transverse cross sectional surface formed of the synthetic resin having thermal resistance, weather resistance, satisfactory electric insulation properties, in the present embodiment, PBT. The inner diameter size d2 of the support hole 21*a* is formed to be slightly greater than the protrusion portion of the support step portion 11*d* of the lamp main body 11, that is, the diameter size d1 of the outer peripheral surface of the protrusion 11*e* (d1<d2). Furthermore, the depth size h3 of the support hole 21*a* is formed to be slightly smaller than the height size h2 of the support step portion 11*d* of the lamp main body 11 (h2>h3).

Furthermore, on the surface side (the upper surface of FIG. 6) of the socket main body 21, a side wall 21*f* is formed so as to integrally raise the outer peripheral portion of the surface forming a flange of the ring. The side wall is a side wall for preventing an electric shock generated by an erroneous insertion of the one side pin-shaped shaft portions 14*a* and 15*a* of the cap member for power source 14 and the cap member for signaling 15 of the lamp with the cap 10 described later into the terminal member for power source 22 and the terminal member for signaling 23 of the socket device 20, and is formed so that the one side shaft portion is not inserted into the respective terminal members of the socket device. In the present embodiment, the protrusion size h1 of the cap members 14 and 15 is about 6 mm, and the height h4 of the side wall is formed to be about 5 mm.

In addition, on the inner peripheral surface of the support hole 21*a*, the engaging means 21*a*1 of the socket device 20 is formed. The engaging means is means for mounting the lamp with the cap 10 with respect to the socket device 20 by the rotation operation in an attachable and detachable manner together with the engaging means 11*f* of the lamp with the cap 10. In the present embodiment, the engaging means of the socket device 20 is constituted by integrally forming the engaging groove 21*a*1 on the inner peripheral surface of the support hole 21*a* (hereinafter, the engaging means 21*a*1 of the socket device is called a "engaging groove 21*a*1").

Figure 5A:
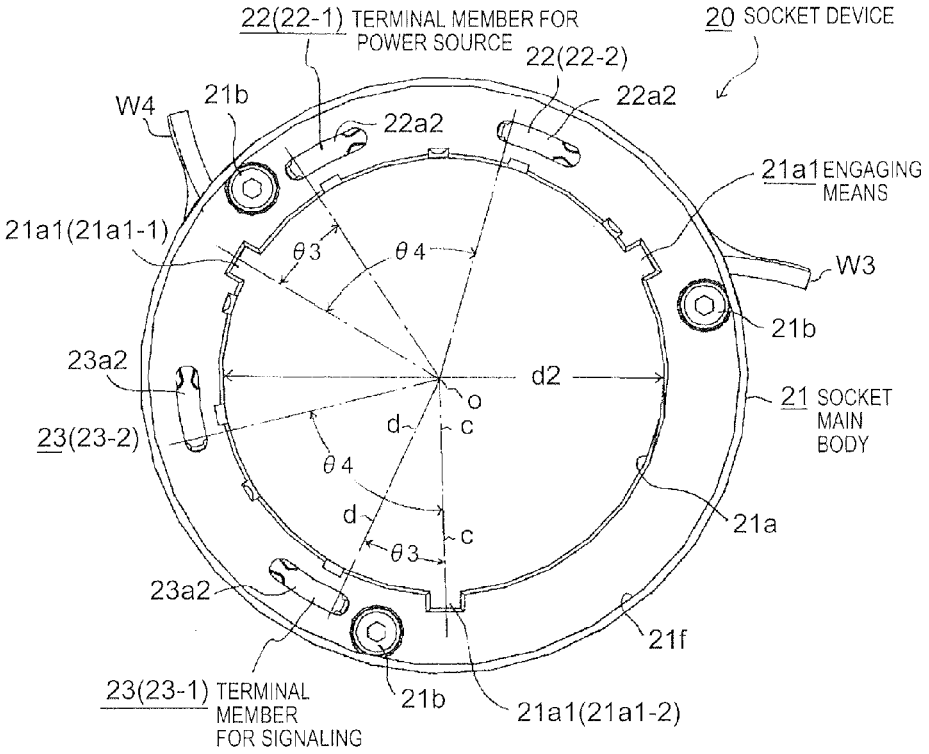
FIG. 5 shows a socket device, FIG. 5(*a*) is a front view, and FIG. 5(*b*) is a side view.
Figure 5B:
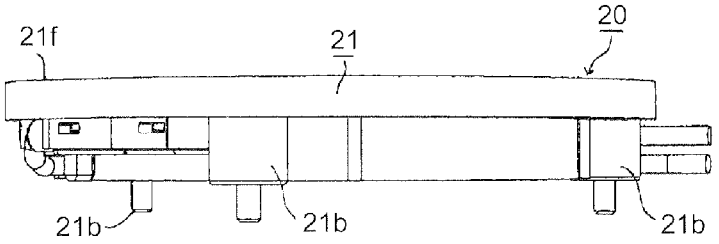
Figure 6A:
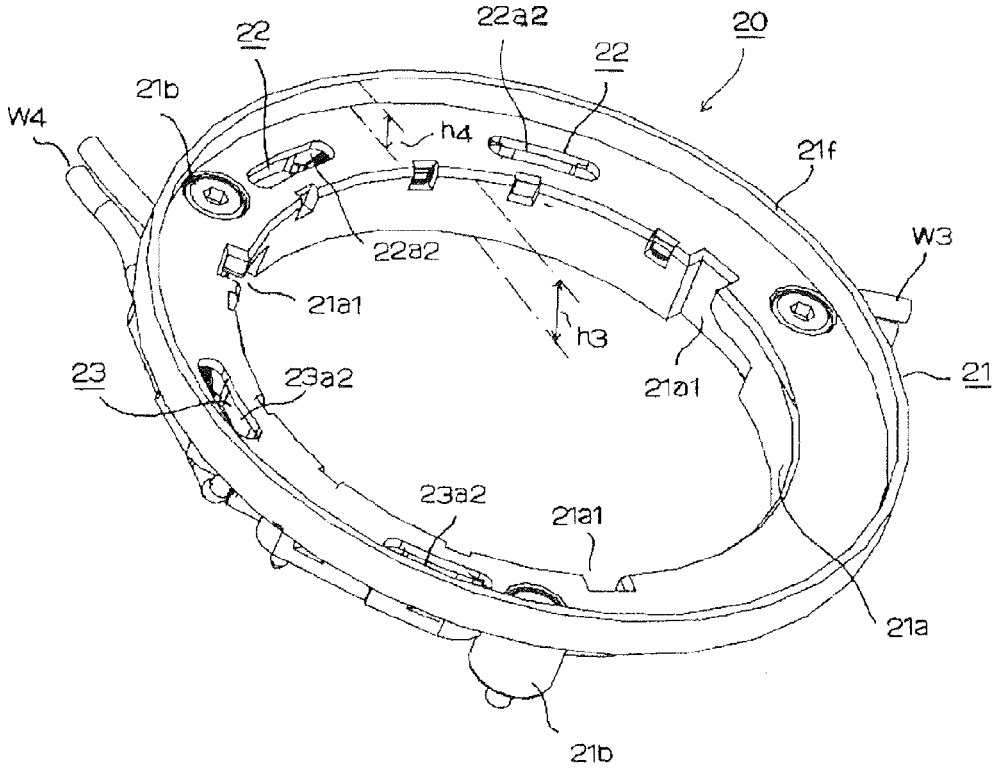
FIG. 6 shows the socket device, FIG. 6(*a*) is a perspective view viewed from a surface side, and FIG.6(*b*) is an enlarged front view that shows engaging means.
Figure 6B:
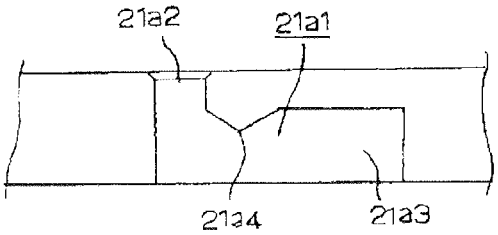

As shown in FIG. 5, three engaging grooves 21*a*1 of the same shape are formed to have the uniform interval with respect to the inner peripheral surface of the support hole 21*a* at an angle of 120° from the center o of the socket main body 21 in the diametrical direction. As shown in FIG. 6(*b*), the respective engaging grooves 21*a*1 include an insertion portion 21*a*2 forming a longitudinal groove opened to the end surface of the support hole 21*a*, an engaging portion 21*a*3 forming a transverse groove formed in a substantially horizontal direction (the rotation direction of the lamp with the cap 10) continued to the insertion portion, and a lower corner portion forming a boundary between the insertion portion 21*a*1 forming a L shape and the engaging portion 21*a*3, in other words, a mountain-shaped locking protrusion 21*a*4 formed in a portion becoming an inlet of the engaging groove 21*a*1. In addition, the engaging protrusion 11*f* of the lamp main body 11 inserted from the insertion portion 21*a*2 slides and is guided to the mountain-shaped locking protrusion 21*a*4 while coming contact therewith, is configured so as to be introduced into the engaging portion 21*a*3 beyond the peak of the mountain shape, prevents the half-engagement as mentioned later by the mountain-shaped locking protrusion 21*a*4, and is not accidentally detached during engagement.

Figure 8A:
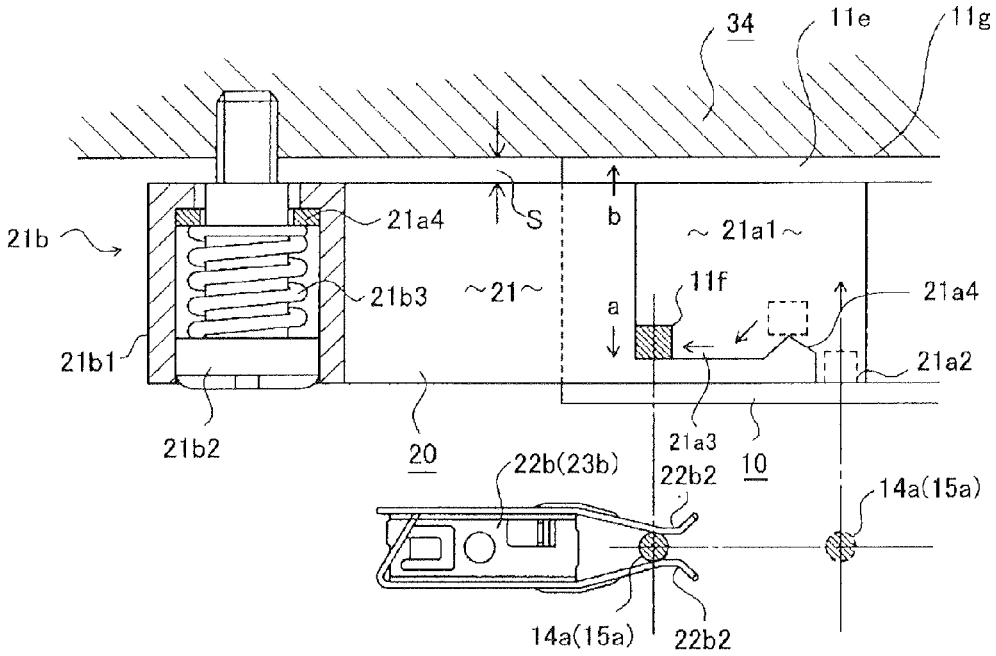
FIG. 8 is a diagram which schematically shows an operation of the engaging means in the lamp with the cap and the socket device and a state of a support member and an electric connection, FIG. 8(*a*) is a diagram that shows a state where the engaging means is engaged, and FIG. 8(*b*) is a diagram that shows a state where the engaging means is not engaged.
Figure 8B:
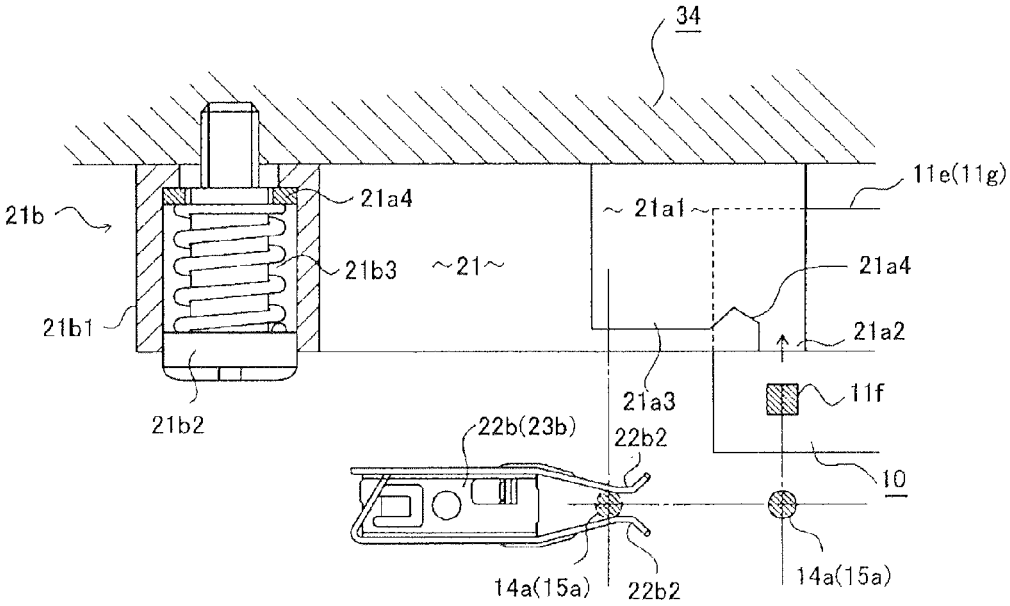

Furthermore, on the rear side (the lower surface of FIG. 6(*a*)) of the socket main body 21, an installation target portion, in the present embodiment, the support member 21*b* for supporting the socket main body 21 with respect to the thermal radiator 34 of the luminaire 30 described later is provided. Three support members 21*b* are formed to have the uniform interval on the lower surface of the ring-shaped socket main body 21 at an angle of 120° from the center o of the socket main body 21 in the diametrical direction. Two support members 21*b* therein are provided in a position adjacent to the engaging groove 21*a*1. The respective support members 21*b* form the same shape, and, as shown in FIG. 8, include the cylindrical cylinder 21*b*1, the bolt 21*b*2 inserted into the cylinder, and the coil spring 21*b*3 inserted into the bolt.

The cylinder 21*b*1 is formed so as to be integrally erected by the resin molding on the rear side of the surface forming the ring-shaped flange of the socket main body 21, and an end plate 12*a*4 is locked to the opening end portion of the upper surface of the cylinder 21*b*1. The tip portion of the bolt 21*b*2 passes through the end plate, the bolt is provided so as to be vertically moved in the cylinder, the tip of the bolt is projected from the upper surface side of the cylinder 21*b*1. The socket device 20 is supported on the installation target portion, in the present embodiment, the thermal radiator 34 of the luminaire 30 by the bolt 21*b*2. The thermal radiator 34 is formed with a screw hole for screwing the bolt 21*b*2 on the rear side (the lower surface in FIG. 8), the bolt 21*b*2 is screwed into the screw hole, and the socket device 20 is supported on the lower surface of the thermal radiator 34.

In this manner, the socket device 20 supported on the thermal radiator 34 of the luminaire 30 is mounted with the lamp with the cap 10, whereby the flat thermal conduction surface 11*g* of the protrusion portion 11*e* of the lamp main body 11 is pressed toward the back of the thermal radiator 34 by elasticity of the spring 21*b*3. That is, as shown in FIG. 8(*a*), the protrusion portion 11*e* of the lamp main body 11 is inserted to the support hole 21*a* of the socket device 20, the engaging protrusion 11*f* of the lamp main body 11 is engaged with the engaging groove 21*a*1 of the socket device 20, and the engaging protrusion 11*f* is inserted from the insertion portion 21*a*2 and is moved to the left side of FIG. 8(*a*). As a result, the engaging protrusion 11*f* climbs over the mountain-shaped locking protrusion 21*a*4 and is introduced into the engaging portion 21*a*3, and the lamp with the cap 10 is mounted on the socket device 20. At this time, the socket main body 21 is pressed downward (a direction of an arrow a in FIG. 8(*a*)) by the lower surface of the engaging protrusion 11*f* of the lamp main body 11 and is separated from the rear side of the thermal radiator 34, and the gap s is formed. At the same time, the spring 21*b*3 of the socket main body 21 is compressed by the pressing, and the lamp main body 11 is strongly pressed to the back of the thermal radiator 34 by repulsive power (power in an arrow b direction in FIG. 8(*a*)). As a result, the flat thermal conduction surface 11*g* of the protrusion portion 11*e* of the lamp main body formed of aluminum and the back of the thermal radiator 34 thermally adhere to each other and are supported, whereby heat generated from the plurality of LEDs 12*a* can be effectively radiated to the outside. Thus, it is possible to use the LED of high luminance and high output.

In addition, when detaching the lamp with the cap 10 from the socket device 20, the lamp main body 11 is rotated oppositely from the above, the engaging protrusion 11*f* of the lamp main body 11 is moved along the engaging portion 21*a*3 of the socket device 20 and is drawn from the insertion portion 21*a*2, and the protrusion portion 11*e* of the lamp main body 11 may be drawn from the support hole 21*a* of the socket device 20. When detaching the lamp with the cap 10 from the socket device 20, as shown in FIG. 8(*b*), the compression of the spring 21*b*3 is released and is returned to the original position, and the upper surface of the socket main body 21 is supported on the rear side of the thermal radiator 34 without the gap.

Figure 9A:
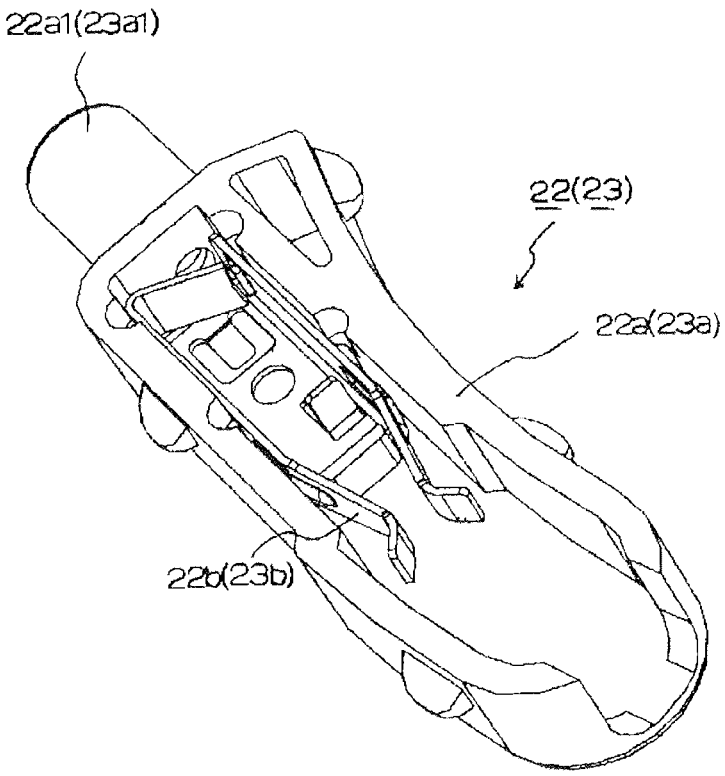
FIG. 9 shows a terminal board in the socket device, FIG. 9(*a*) is a perspective view that shows a state where the terminal board is accommodated in a terminal case, and FIG. 9(*b*) is a perspective view of the terminal board.
Figure 9B:
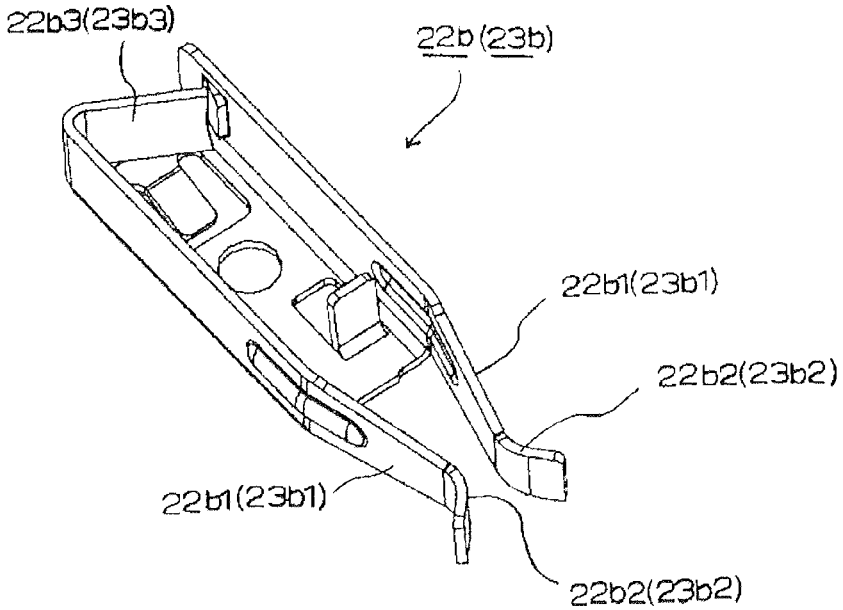

Next, as shown in FIG. 9, the terminal portion for power source 22 connected to the cap member for power source 14 of the lamp with the cap 10 includes a small terminal case 22*a* integrally formed with the socket main body 21 and a terminal plate 22*b* accommodated in the terminal case. A pair of terminal cases 22*a* is integrally provided adjacent to the rear side (FIG. 7) of the surface forming the flange shape of the ring of the socket main body 21, accommodates the terminal plate 22*b* in the case, and a wire insertion portion 22*a*1 is integrally formed in one end portion thereof.

The terminal plate 22*b* is a member with which the shaft portion 14*a* of the cap member for power source 14 comes into contact to supply the lamp with the cap 10 with the commercial power source, has constant rigidity and spring characteristics, and is formed of a metal having satisfactory electric conductivity, for example, a copper, a brass, a phosphor bronze or the like, in the present embodiment, the phosphor bronze. The terminal plate 22*b* has two terminal pieces 22*b*1 formed by bending the entirety so as to form a substantial U shape, a contact portion 22*b*2 formed by bending the tip portion of the terminal piece in a substantial "V" shape in a direction facing each other, and a locking piece 22*b*3 formed in the U-shaped bottom side portion, and is configured as a spring-less SL terminal.

The terminal plate 22*b* configured as above is fitted into the terminal case 22*a* integrally formed adjacent to the one side of the engaging groove 21*a*1-1 on the rear side (FIG. 7) of the surface forming the flange of the ring of the socket main body 21. The terminal case 22*a* is formed by the arc-shaped concave portion formed along the ring-shaped socket main body 21, and includes a wire insertion portion 22*a*1, a long hole 22*a*2 opened to the surface side (FIG. 6) of the socket main body 21, and a lid 22*a*3 that covers the opening of the rear side.

The long hole 22*a*2 is formed in an arched form having a semi-circular opening on both end portions thereof, and is formed so that the elongated small terminal plate 22*b* is not dropped from the long hole. Furthermore, the width size is formed to a size by which the cylindrical shaft portion 14*a* of the cap member for power source 14 in the lamp with the cap 10 can be inserted and moved. Furthermore, the lid 22*a*3 covers the opening of the rear side of the terminal case 22*a* and integrally forms the electric wire guide piece 22*a*4 on the upper surface situated on the electric wire insertion portion 22*a*1.

Figure 7:
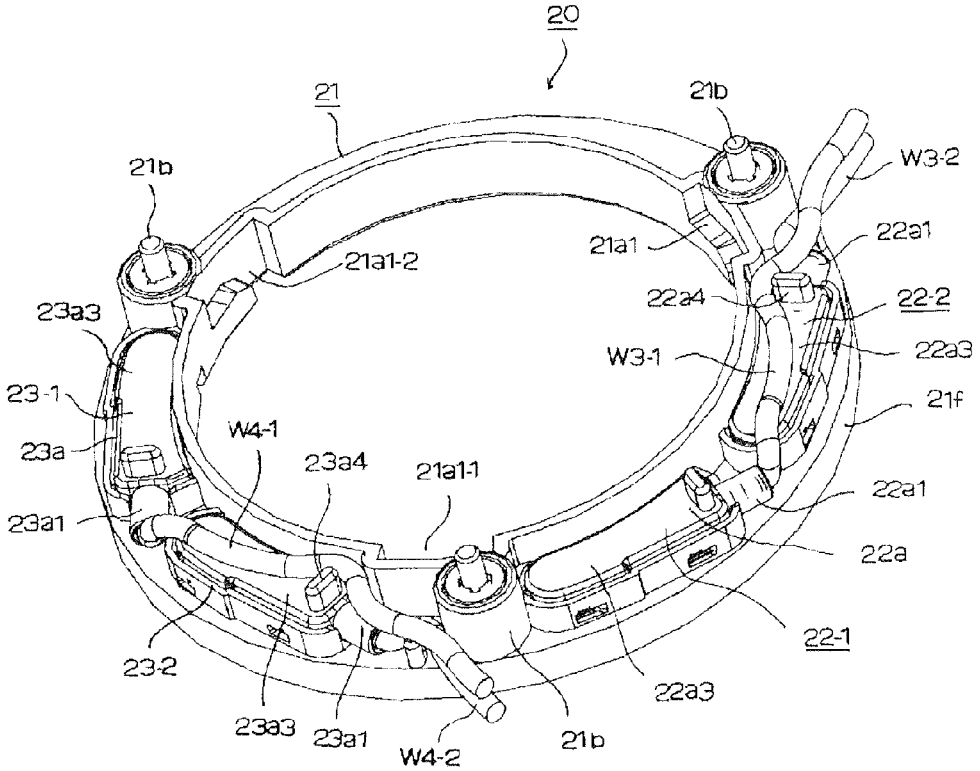
FIG. 7 is a perspective view in which the socket device is viewed from the rear side.

A pair of the terminal cases 22*a* and the terminal plates 22*b* configured as mentioned above having the same configuration are prepared, and are accommodated in the respective terminal case 22*a* so that the respective terminal plates 22*b* face the long hole 22*a*2. Moreover, the opening of the rear side of the terminal case 22*a* is closed by the lid 22*a*3, and is fixed by adhesive formed of the silicone resin, the epoxy resin or the like. As a result, as shown in FIG. 7, the pair of terminal members for power source 22-1 and 22-2 are situated adjacent to the engaging groove 21*a*1-1 of the socket device 20, that is, one side with the engaging means interposed therebewtween, and are disposed on the circular track of the socket main body 21.

Next, the terminal member for signaling 23, to which the cap member for signaling 15 of the lamp with the cap is connected, has the same configuration as that of the terminal member for power source 14, and the detailed descriptions of the configurations of the terminal case 23*a* and the terminal plate 23*b* will be omitted by displaying the reference numerals of the respective components in the terminal member for signaling 23 in parenthesis in FIG. 9.

With such a configuration, the pair of terminal members for signaling 23-1 and 23-2 is situated adjacent to the engaging groove 21*a*1-1 of the socket device 20, that is, the other side with the engaging means interposed therebetween, and is disposed on the circular track of the socket main body 21. Furthermore, the circular track, on which the terminal member for signaling 23 is disposed, is disposed on the same circular track as the circular track of the terminal member for power source 22, and is configured so as not to disturb the reduction in size. In addition, the circular track may be disposed on the different circular track within the scope not disturbing the reduction in size.

As mentioned above, as shown in FIG. 7, the terminal member for power source 22 and the terminal member for signaling 23 are separated from each other in both directions of the engaging groove 21*a*1-1 by a predetermined size with the engaging groove 21*a*1-1 (the engaging means) interposed therebetween, are situated adjacent to each other, and are disposed on the circular track of the socket main body 21.

The angle sizes of the terminal member for power source 22, the terminal member for signaling 23 and the three engaging grooves 21*a*1, that is, the angle size of the socket device 20 side is disposed as mentioned below. That is, as shown in the top view of the socket device of FIG. 5, when showing the angle facing the diametrical direction from the center o starting from two engaging grooves 21*a*1-1 and engaging protrusion 21*a*1-2 in the engaging groove 21*a*1 formed to have the uniform gap at an angle of 120°, an angle θ3 facing the diametrical direction of one terminal member for power source 22-1 adjacent to the engaging groove 21*a*1-1 is 25°, and an angle θ4 facing the diametrical direction of the other (the other side separated from the engaging groove 21*a*1-1) terminal member for power source 22-2 is 75°.

Furthermore, the angle θ3 facing the diametrical direction of one terminal member for signaling 23-1 adjacent to the engaging groove 21*a*1-2 is 25°, and the angle θ4 facing the diametrical direction of the other (the other side separated from the engaging groove 21*a*1-2) terminal member for signaling 23-2 is 75°.

In addition, the respective angles θ3 and θ4 are angles formed between the line c-c passing through the center axis of the insertion portion 21*a*2 of the engaging groove 21*a*1 and the line d-d passing through the center of the respective semi-circular portion of the insertion side (a portion into which the pin-shaped shaft portions 14*a* and 15*a* of the lamp with the cap 10 are initially inserted) in the respective long holes 22*a*2 and 23*a*2 of the terminal member for power source 22 and the terminal member for signaling 23. Furthermore, a rotation angle α1 of the lamp with the cap 10 relative to the socket device 20 is 15°. In addition, the inner diameter size d2 of the support hole 21*a* is about 65.5 mm. The angle and the size mentioned above are allowed within the scope of the manufacturing error. In addition, as mentioned above, the position relationship of the pair of terminal member for power sources 22 and the pair of terminal members for signalling 23 may be reversed.

Furthermore, the electric wire for power source w3 is connected to the terminal member for power source 22 configured as mentioned above, and the electric wire for signaling w4 is connected to the terminal member for signaling 23. As shown in FIG. 7, in the electric wire for power source w3, the electric wire for power source w3-1 connected to one terminal member for power source 22-1 adjacent to the engaging groove 21*a*1-1 is drawn from the electric wire insertion portion 22*a*1, is derived along the upper surface of the other (the other side separated from the engaging groove 21*a*1-1) terminal member for power source 22-2, that is, the upper surface of the lid 22*a*3, is guided to the electric wire guide piece 22*a*4, is interposed between the electric wire guide piece 22*a*4 and the side wall of the socket main body 21 to prevent the falling-out, and is drawn. Furthermore, the electric wire for power source w3-2 connected to the other (the other side separated from the engaging groove 21*a*1-1) terminal member for power source 22-2 is drawn from the electric wire insertion portion 22*a*1, is vertically bundled together with the electric wire for power source w3-1 drawn in advance in an overlapping manner, and is drawn.

The respective electric wires for power source w3-1 and w3-2 are derived along the upper surface of the terminal member for power source 22-2, are vertically bundled by the electric wire guide piece 22*a*4 in an overlapping manner, are received in the width size of the rear side of the surface forming the flange shape of the ring of the ring-shaped socket main body 21, and are wired compactly without popping out of the electric wire for power source from the outer peripheral surface of the socket device. Thus, the reduction in size of the socket device 20 can be achieved without a need to increase the outer diameter size of the socket main body in order to conceal the drawn electric wire for power source.

The electric wire for signaling w4 is connected like the electric wire for power source w3. That is, the electric wire for signaling w4-1 connected to the one terminal member for signaling 23-1 adjacent to the engaging groove 21*a*1-2 is drawn from the electric wire insertion portion 23*a*1, is derived along the other (the other side separated from the engaging groove 21*a*1-2) upper surface of the terminal member for signaling 23-2, that is, the upper surface of the lid 23*a*3, is guided to the electric wire guide piece 23*a*4, is interposed between the electric wire guide piece 22*a*4 and the side wall of the socket main body to prevent the falling-out, and is drawn. Furthermore, the electric wire for signaling w4-2 connected to the other (the other side separated from the engaging groove 21*a*1-2) terminal member for signaling 23-2 is drawn from the electric wire insertion portion 23*a*1, is vertically bundled together with the electric wire for signaling w4-1 drawn in advance in an overlapping manner, and is drawn.

The respective electric wires for signaling w4-1 and w4-2 are also derived along the upper surface of the terminal member for signaling 23-2, are vertically bundled by the electric wire guide piece 22*a*4 in an overlapping manner, are received in the width size of the rear side of the surface forming the flange shape of the ring of the ring-shaped socket main body 21, and are wired compactly without popping out of the electric wire for signaling from the outer peripheral surface of the socket device 20. Thus, the reduction in size of the socket device 20 can be achieved.

In addition, the insulation coating of the tip of the respective electric wires w3 and w4 is peeled off, is locked and connected to the locking pieces 22*b*3 and 23*b*3 of the SL terminal by being fitted into the electric wire insertion portions 22*a*1 and 23*a*1 of the respective terminal cases 22*a* and 23*a*. Furthermore, the respective electric wires w3 and w4 drawn from the socket device 20 are connected to terminal boards 35 and 36 of the luminaire 30 described later.

Furthermore, as shown in FIG. 7, the terminal member for power source 22 and the terminal member for signaling 23 are separated from each other on both sides of the engaging groove 21*a*1-1 by a predetermined size with the engaging groove 21*a*1-1 (the engaging means) interposed therebetween and are situated adjacent to each other, and the wiring of the electric wire for power source w3 and the electric wire for signaling w4 is disposed on the circular track of the socket main body 21. As a result, the wiring of the electric wire for power source w3 and the electric wire for signaling w4 can be performed in one location be being focused on both sides of the engaging groove 21*a*1-1, the wiring can be simplified, and the reduction in size of the lamp with the cap 10 can be achieved.

When the terminal member for power source 22 and the terminal member for signaling 23 are situated to face each other in the diametrical direction, there is a need to perform the wiring of the respective electric wires w3 and w4 in a position separated in the diametrical direction, and there is a need to draw the respective electric wires in the socket main body 21, and thus there is a need for the space for drawing. For this reason, the wiring operation is complicated, and it is difficult to achieve the reduction in size of the socket main body.

Furthermore, at the same time, the terminal member for power source 22 and the terminal member for signaling 23 are separated from each other and are situated on both sides of the engaging groove 21*a*1-1 by a predetermined size with the engaging groove 21*a*1-1 (the engaging means) interposed therebetween. Thus, the electric wire for signaling w4 and the terminal member for signaling 22 can make it possible to pick up the noise easily generated from the electric wire for power source w3 and the terminal member for power source 23.

Figure 10:
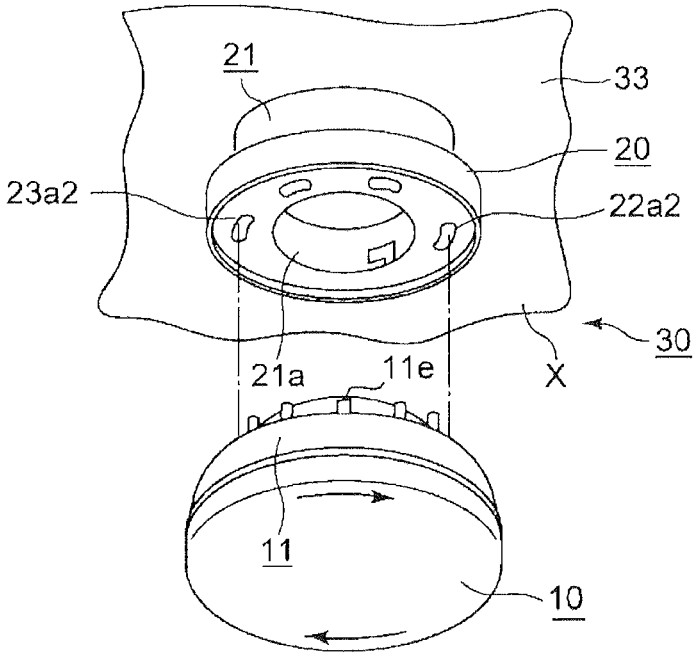
FIG. 10 is a perspective view that shows a state of installing the lamp with the cap to the socket device.
Figure 11A:
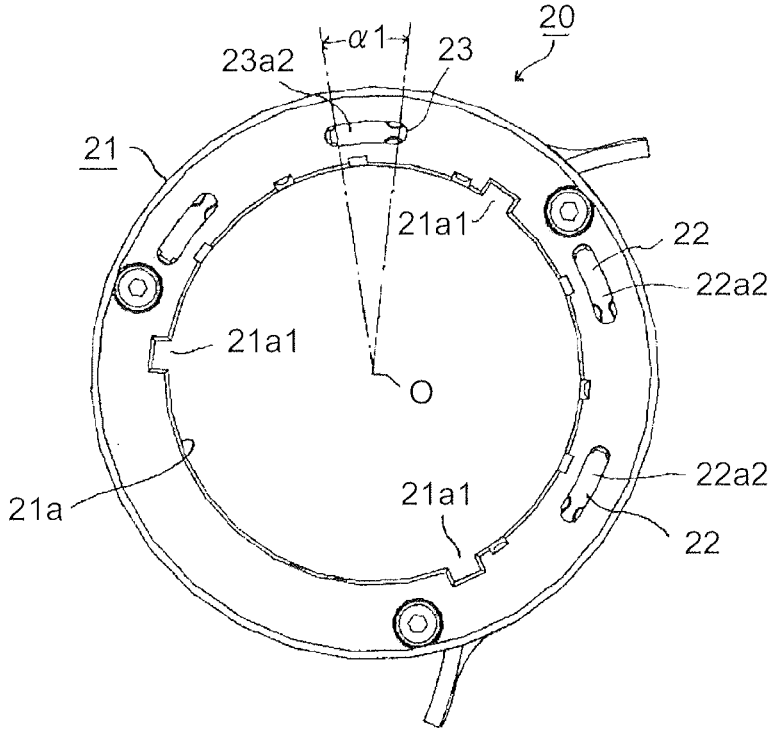
FIG. 11 shows a state of mounting the lamp with the cap on the socket device, FIG. 11(*a*) is a front view of the socket device, and FIG. 11(*b*) is a rear view of the cap member.
Figure 11B:
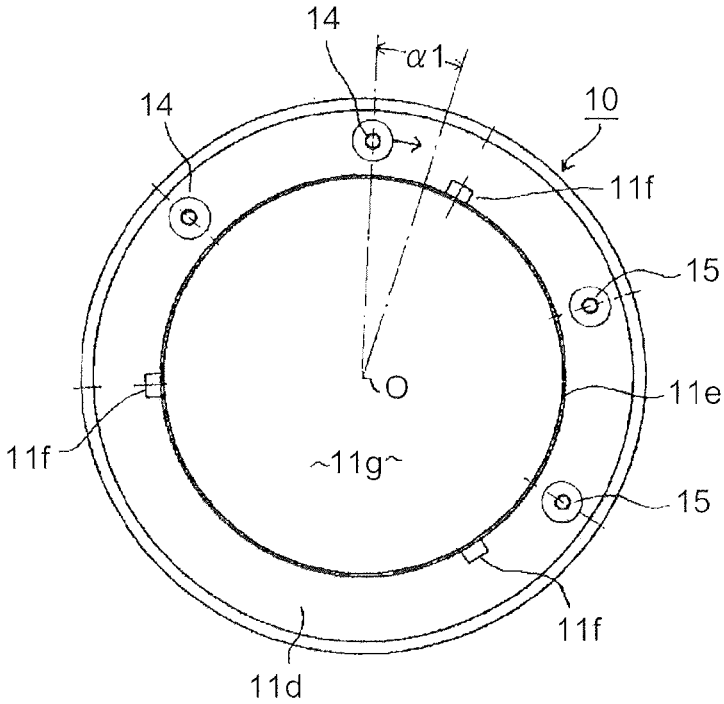

As mentioned above, the terminal member for power source 22 and the terminal member for signaling 23 are configured. As shown in FIG. 10, the protrusion portion 11*e* of the lamp with the cap 10 is inserted into the support hole 21*a* of the socket device 20. As shown in FIG. 11, the lamp with the cap 10 is rotated around the center point o of the socket main body 21 in an arrow direction in FIG. 11 by an angle $\alpha 1$, in the present embodiment, an angle of 15°. As a result, the cap member for power source 14 of the lamp with the cap 10 is inserted from the long hole 22*a*2 of the terminal member for power source 22 and is moved to the terminal plate 22*b*, and at the same time, the cap member for signaling 15 is inserted from the long hole 23*a*2 of the terminal member for signaling 23 and is moved to the terminal plate 23*b*. Moreover, as shown in FIG. 8, the cylindrical shaft portions 14*a* and 15*a* of the cap member for power source 14 and the cap member for signaling 15 are inserted into two terminal pieces 22*b*1 and 23*b*1, respectively, and are stopped in a position climbing over the contact portions 22*b*2 and 23*b*2 of the mutually facing "V" shape of the terminal plate. In this state, both side portions of the shaft portions 14*a* and 15*a* and the two contact portions 22*b*2 and 23*b*2 come into contact with each other, and the electric connection between the power source portion and the signal portion is concurrently performed. As shown in FIG. 8(*a*), the contact position is configured so that the engaging protrusion 11*f* of the lamp main body 11 comes into contact with and is engaged with the end of the engagement portion 21*a*3 of the engaging groove 21*a*1 in the socket main body 21.

As mentioned above, the electric connection between the lamp with the cap 10 and the socket device 20 is performed, and the mechanical holding, that is, the lamp with the cap 10 is mounted on the socket device 20. At this time, by setting the relationship between the engaging means (the engaging protrusion 11*f* and the engaging groove 21*a*1) for mounting the lamp with the cap 10 to the socket device 20 in an attachable and detachable manner and the electric connection as below, the half-engaged state when mounting the lamp with the cap 10 to the socket device 20 is avoided.

That is, as shown in FIG. 8(*a*), the electric connection, that is, the contact between the shaft portion 14*a* of the cap member for power source 14 and the terminal plate 22*b* and the contact between the shaft portion 15*a* of the cap member for signaling 15 and the terminal plate 23*b* are configured to be performed after the engaging protrusion 11*f* climbs over the mountain-shaped engaging protrusion 21*a*4 of the engaging groove 21*a*1. For this reason, in the middle of the rotation operation, a user receives the resistance with respect to the rotation operation when the engaging protrusion 11*f* climbs over the protrusion 21*a*4, and thus a user may confuse that the engagement is made to stop the rotation operation. However, at that time, the lamp is not lit because the electric connection has not been performed yet. For this reason, a user understands that the engagement is not completed yet and performs the rotation operation to the last. As a consequence, it is prevented that the rotation operation is stopped in the middle, and it is possible to avoid the half-engaged state (a state before the locking protrusion 11*f* climbs over the mountain-shaped locking protrusion 21*a*4) in the engaging means. As a result, it is possible to reliably mount the lamp with the cap 10 to the socket device 20.

Furthermore, in the rotation operation, by performing a smooth operation, simple operation is realized by the one touch operation, and the half-engaged state of the engaging means and the half-contact state of the electric connection are avoided. That is, the resistance in the rotation operation is received in two stages of the resistance received when the engaging protrusion 11*f* climbs over the locking protrusion 21*a*4 and the resistance received when the shaft portions 14*a* and 15*a* climb over the mutually opposing "V"-shaped contact portions 22*b*2 and 23*b*2 of the terminal plates 22*b* and 23*b*. For this reason, a user receives the resistance in two stages in the middle of the rotation operation, whereby a user may confuse that the engagement is made twice and may stop the rotation operation. Particularly, the second resistance is the resistance for performing the electric connection, and when confusing the same to stop the rotation operation, the half-contact state (the state before the shaft portions 14*a* and 15*a* climb over the mutually opposing "V" shaped contact portions 22*b*2 and 23*b*2 of the terminal plates 22*b* and 23*b*) may occur.

In the present embodiment, in order to prevent the state, a configuration was adopted in which the second resistance received when the shaft portions 14*a* and 15*a* climb over the mutually opposing "V"-shaped contact portion is reduced compared to the first resistance received when the engaging protrusion 11*f* climbs over the locking protrusion 21*a*4. Specifically, when the first resistance is 100%, the second resistance is set to be about equal to or less than 70%.

As a result, in the rotation operation, by the rotational force resisting with the first resistance and inertia of the rotation, the second resistance can be simply climbed over, the rotation operation can be performed only by receiving the first resistance, and the rotation operation by the one touch operation is realized. At the same time, since the second resistance can be simply climbed over, the shaft portions 14*a* and 15*a* can climb over the mutually opposing "V"-shaped contact portions 22*b*2 and 23*b*2, and it is possible to reliably avoid the electric half-contact state.

Furthermore, the engaging protrusion 11*f* comes into contact with the end of the engaging portion 21*a*3 of the engaging groove 21*a*1, whereby the stop of the rotation operation is performed. At the time of the contact, the engaging protrusion 11*f* formed of aluminum comes into contact with the engaging groove 21*a*1 formed of the synthetic resin, whereby the metallic sound "cutch" is generated. As a result, the state where the engaging means is engaged, that is, the state, where the lamp with the cap 10 is completely mounted on the socket device 20, can be easily notified to a user by sound.

Figure 12A:
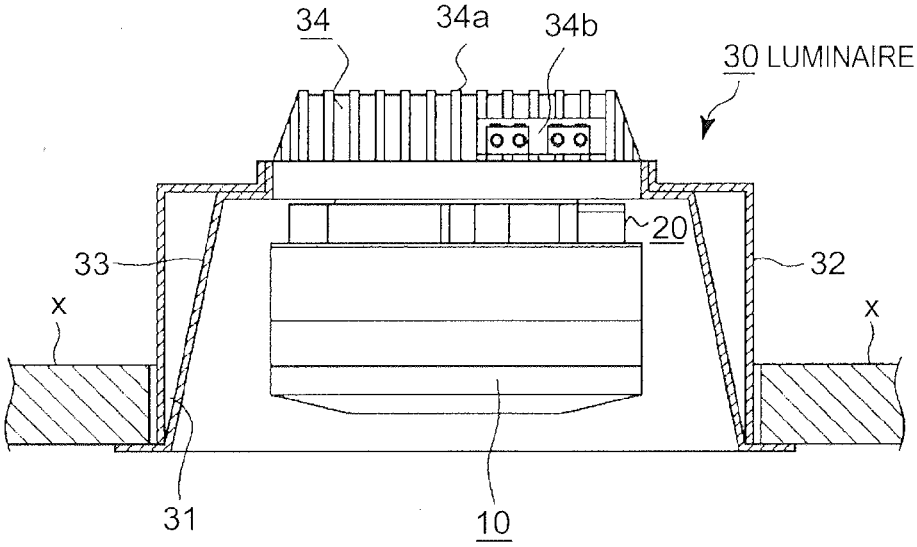
FIG. 12 shows a luminaire in which the lamp with the cap is mounted on the socket device, FIG. 12(*a*) is a cross-sectional view that shows a state where a downlight is installed in a ceiling, and FIG. 12(*b*) is a cross-sectional perspective view which shows the lamp with the cap and the socket device of FIG. 12(*a*) in cross-section.
Figure 12B:
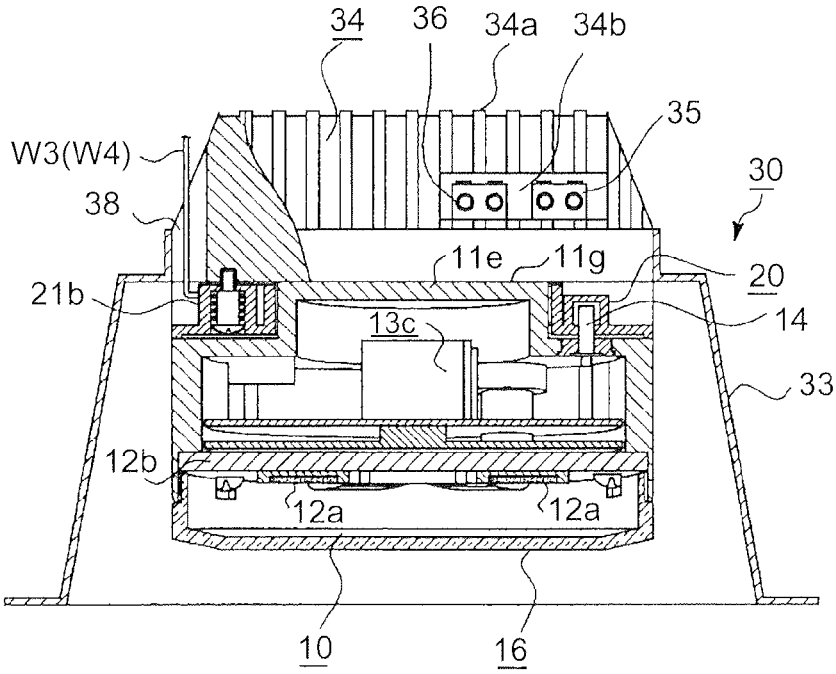

Next, a configuration of the luminaire including the lamp with the cap 10 and the socket device 20 configured as above will be described. As shown in FIG. 12, reference numeral 30 is a small down light type luminaire embedded and installed in a ceiling surface X of a store, and includes a luminaire main body 32 forming a box shape made of a metal having an opening portion 31 on the lower surface thereof, a reflector 33 made of a metal fitted to the opening portion 31, and a thermal radiator 34 provided on the upper surface of the reflector 33. The socket device 20 having the configuration mentioned above is installed in the substantially middle portion of the back of the thermal radiator 34. The reflector 33 is formed of a metal having satisfactory thermal conductivity, for example, a metal plate such as a stainless steel, and is configured by mounting the upper surface thereof to the side of the thermal radiator 34.

The thermal radiator 34 has a function as the heat sink and is constituted by a block formed of a metal having satisfactory thermal conductivity, in the present embodiment, thick aluminum. A plurality of thermal radiation fins 34*a* are integrally formed on the outer peripheral surface thereof. Furthermore, the thermal radiator 34 is formed with a screw hole for attaching the socket device 20 on the rear side thereof (the lower surface of FIG. 12), and is supported by screwing the bolt 21*b*2 of the socket device 20 with respect to the screw hole (FIG. 8). Furthermore, the side of the thermal radiator 34 is partially notched to integrally form an installation portion 34*b* on which the terminal board is installed. The terminal board includes the terminal board for power source 35 and the terminal board for signaling 36. The terminal board for wiring may be further provided.

Furthermore, the electric wire for power source w3 drawn from the socket device 20 is connected to the output terminal of the terminal board for power source 35, and the F cable F1 wired in the indoor is connected to the input terminal. Furthermore, the electric wire for signaling w4 drawn from the socket device 20 is connected to the output terminal of the terminal board for signaling 36, and the signal line S1 is connected to the input terminal.

As shown in FIG. 4, the F cable is connected to the commercial power source E and, when the cap member for power source 14 is connected to the terminal member for power source 22 of the socket device 20, the power is supplied from the terminal member for power source 22 to the lamp with the cap 10 via the cap member for power source 14. Furthermore, the signal line S1 is connected to the dimmer 37, and when the cap member for signaling 15 is connected to the terminal member for signaling 23 of the socket device 20, the control signal from the dimmer 37 is transmitted from the terminal member for signaling 23 to the lamp with the cap 10 via the cap member for signaling 15. The dimmer 37 is a device which is used for the existing incandescent lamp, and is installed in a wall surface of a room so that a user can operate. In addition, the respective electric wires w3 and w4 are drawn from the electric wire derivation hole 38 formed in the thermal radiator 34.

In the luminaire 30 configured as mentioned above, the LED mentioned above is used as a light source, the lamp with the cap 10 of the flat thin type structure provided with the pin type cap member for power source 14 and the cap member for signaling 15 is mounted on the socket device 20. As shown in FIGS. 10 and 11, the mounting is performed by inserting the respective shaft portions 14*a* and 15*a* into the long holes 22*a*2 and 23*a*2 of the socket device 20 in the state of causing the pair of the cap members for power source 14 of the lamp with the cap 10 to face the long hole 22*a*2 and causing the pair of the cap members for signaling 15 to face the long hole 23*a*2 of the socket device 20, respectively. At the same time, three engaging protrusions 11*f* of the lamp with the cap 10 are caused to face the three engaging grooves 21*a*1 of the socket device 20, respectively, and are inserted into the respective insertion portions 21*a*2.

At this time, the side wall 21*f* is formed on the surface side of the socket device 20, whereby the pins (the shaft portions 14*a* and 15*a*) of one side of the cap member for power source 14 and the cap member for signaling 15 of the lamp with the cap 10 are not erroneously inserted into the terminal member for power source 22 and the terminal member for signaling 23 of the socket device 20, and the occurrence of shock is prevented.

Moreover, the lamp with the cap 10 is rotated in an arrow direction in the drawing by 15°. As a result, as shown in FIG. 8(*a*), the shaft portions 14*a* and 15*a* of the cap member for power source 14 and the cap member for signaling 15 are inserted into two terminal pieces 22*b*1 and 23*b*1, respectively, and are stopped in a position climbing over the mutually opposing "V"-shaped contact portions 22*b*2 and 23*b*2 of the terminal piece. In this state, both side portions of the shaft portions 14*a* and 15*a* and the two contact portions 22*b*2 and 23*b*2 come into contact with each other, and the electric connection is made. At the same time, the engaging protrusion 11*f* of the lamp with the cap 10 inserted from the insertion portion 12*a*2 of the engaging groove 21*a*1 in the socket device 20 is guided while sliding and coming into contact with the mountain-shaped locking protrusion 21*a*4, climbs over the mountain-shaped apex, is introduced into the engaging portion 21*a*3, and comes into contact with the end of the engaging portion 21*a*3.

At this time, the electric connection is configured to be performed after the engaging protrusion 11*f* climbs over the mountain-shaped locking protrusion 21*a*4 of the engaging groove 21*a*1. Thus, in the middle of the rotation operation, a user receives resistance when the engaging protrusion 11*f* climbs over the locking protrusion 21*a*4, and there is a concern that they may mistakenly think that the engagement has been performed. However, at this time, since the electric connection has not been performed yet, the lamp is not lit. For this reason, a user knows that the engagement has not been completed yet and performs the rotation operation to the last, and the half-engaged state is avoided.

Furthermore, when the engaging protrusion 11*f* comes into contact with the end of the engagement portion 21*a*3, there is a "catching" sound. Thus, a user understands that the lamp with the cap 10 is completely engaged with the socket device 20 and it is further prevented that the engagement enters the half-engaged state or the electric connection enters the half-contact state. As a result, the electric connection between the lamp with the cap 10 and the socket device 20 is performed, and at the same time, the lamp with the cap 10 is mounted on the socket device 20. In addition, the lamp with the cap 10 can be detached from the socket device 20 by rotating the former in the opposite direction.

When mounting the lamp with the cap 10 to the socket device 20 by the engaging means mentioned above, as shown in FIG. 8(*a*), the socket main body 21 is pressed downward by the lower surface of the engaging protrusion 11*f* of the lamp main body 11, the spring 21*b*3 of the socket main body 21 is compressed, and the flat thermal conduction surface 11*g* of the cylindrical protrusion portion 11*e* of the lamp main body 11 is strongly pressed against the back of the thermal radiator 34 by the repulsive force. As mentioned above, the down light type luminaire 30 which uses the lamp with the cap 10 which has a thin, flat structure and uses LED as a light source, as a light source is formed.

When supplying the power source in this state, the power is supplied from the terminal member for power source 22 of the socket device 20 via the cap member for power source 14 of the lamp with the cap 10, the lighting circuit 13*a* of the control device 13 is operated, and a direct current voltage of 24V is output. The direct current voltage is applied from the control device 13 to each LED 12*a*, the direct current of the constant current is supplied, and the entire LED is lit simultaneously. The white light emitted from each LED 12*a* is emitted in a substantially uniform manner toward the entire inner surface of the cover member 16, light is diffused by the milky white globe, and it is possible to perform lighting with predetermined light distribution characteristics.

Furthermore, by operating the dimmer 37 installed on the wall surface by a user, the control signal is transmitted from the terminal member for signaling 23 of the socket device 20 to the control circuit 13*b* via the cap member for signaling 15 of the lamp with the cap 10, and the required dimming signal is generated by the control circuit and supplied to the lighting circuit 13*a*. The lighting circuit 13*a* lights each LED 12*a* while dimming the same based on the dimming signal. At this time, the lamp with the cap 10 and the socket device 20 hardly picks up the noise easily generated on the power source side, and thus, stable and correct dimming control can be performed.

As mentioned above, when the lamp with the cap 10 is lit, the temperature of the LED 12*a* rises and heat is generated. As shown in FIG. 1(*b*), the heat is transmitted from the substrate 12*b* formed of aluminum having satisfactory thermal conductivity to the substrate support portion lib to which the substrate directly adheres and is fixed, the flat thermal conduction surface 11*g* of the protrusion portion 11*e* of the lamp main body 11 formed of aluminum, and is radiated to the outside via the thermal radiator 34. At this time, the thermal conduction surface 11*g* of the protrusion portion 11*e* of the lamp main body 11 and the back of the thermal radiator 34 thermally adhere to each other and are supported by the spring 21*b*3, whereby it is possible to effectively radiate the heat to the outside.

Furthermore, the heat generated from the electronic component 13*c* of the control device 13, particularly, the heat generated from the switching transistor 13*c*1 involving the heating is also transmitted from the bottom surface of the lamp main body 11 in which the switching transistor is accommodated in an adhering manner to the concave fitting portion 11*e*, and is effectively radiated to the outside via the thermal radiator 34. With the effective thermal radiation action, the temperature rise of the LED 12*a* and the temperature rise of the electronic component 13*c* in the control device 13 are suppressed, and reliability is improved.

As mentioned above, according to the lamp with the cap 10 of the present embodiment, the cap member for power source 14 connected to the control device 13 is situated adjacent to one side with the engaging means 13*f* interposed therebetween, and is disposed on the circular track of the lamp main body 11. The cap member for signaling 15 connected to the control device 13 is situated adjacent to the other side with the engaging means 13*f* interposed therebetween and is disposed on the circular track of the lamp main body 11, and thus the wiring can be simplified to achieve a reduction in size. Furthermore, it is possible to hardly receive the influence of the noise easily generated on the power source side, whereby it is possible to handle the control of dimming or the like.

Furthermore, according to the socket device 20 of the present embodiment, the terminal member for power source 22, to which the cap member for power source 14 of the lamp with the cap 10 is connected, is situated adjacent to one side with the engaging means 21*a*1 interposed therebetween and is disposed on the circular track of the socket main body 21. The terminal member for signaling 23, to which the cap member for signaling 15 of the lamp with the cap 10 is connected, is situated adjacent to the other side with the engaging means 21*a*1 interposed therebetween and is disposed on the circular trance of the socket main body 21. Thus, the wiring can be simplified to achieve a reduction in size, and it is possible to hardly receive the influence of the noise easily generated on the power source side, whereby it is possible to handle the control of dimming or the like.

As mentioned above, in the present embodiment, the lamp with the cap is preferably constituted by a thin, flat lamp. However, as the shape of the lamp, a lamp shape may be configured such as a bulb-shaped lamp with a cap (A type or PS type) similar to the shape of the general incandescent lamp, a ball-shaped lamp with a cap (G type), a circular lamp with a cap (T type), or a reflector type lamp with a cap (R type). Furthermore, the present embodiment can be applied to a lamp with a cap forming other various external forms and applications without being limited to a lamp with a cap similar to the thin, flat lamp or the shape of the general incandescent lamp. In addition, the lamp with the cap preferably has a cover member formed of a globe, a protection cover or the like for diffusing the light or protecting the light-emitting portion, but the member is not a required condition for achieving the object of the present embodiment, and for example, a globeless lamp with a cap may also be constituted.

Figure 13A:
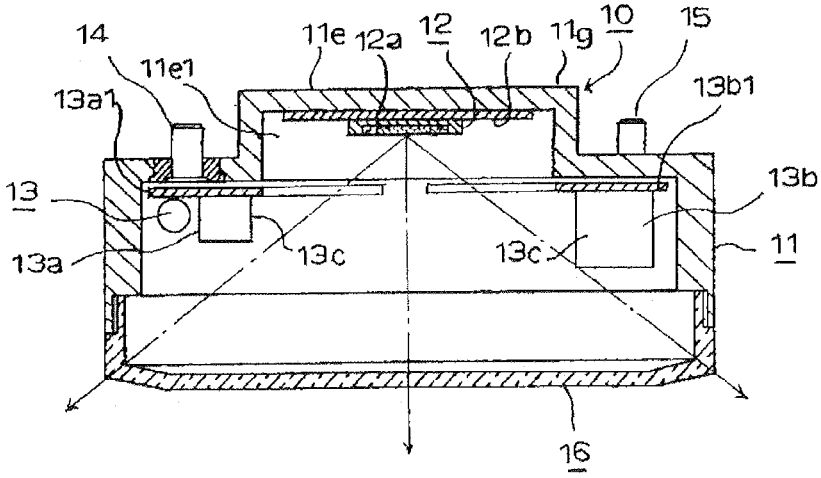
FIG. 13 shows a modified example of the lamp with the cap, FIG. 13(*a*) is a cross-sectional view showing a first modified example corresponding to FIG. 1(*b*), and FIG. 13(*b*) is a cross-sectional view showing a first modified example corresponding to FIG. 2.
Figure 13B:
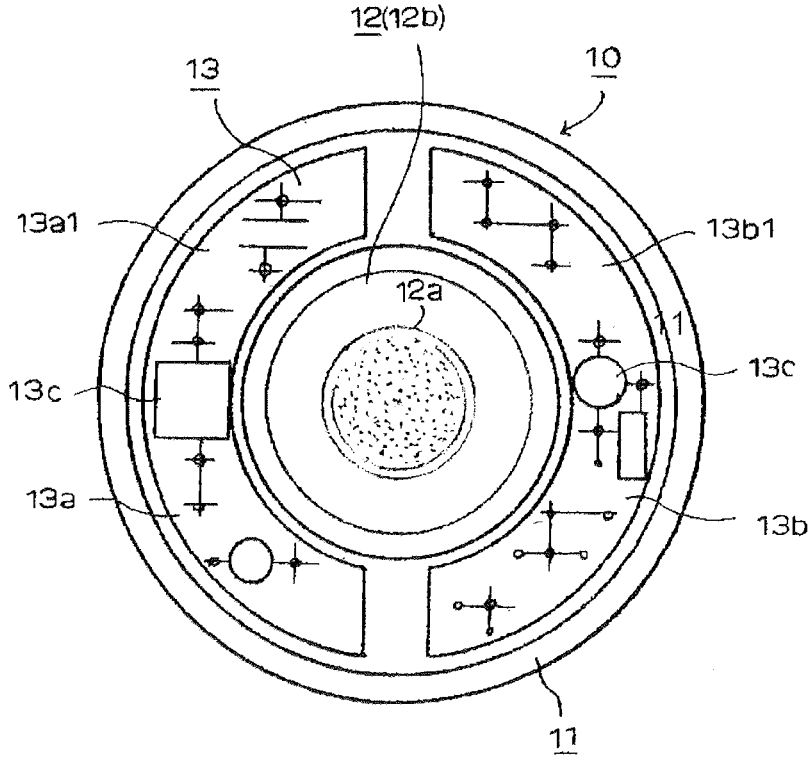

In addition, the lamp with the cap may be configured to incorporate the light-emitting portion 12 into the protrusion portion 11*e* of the lamp main body 11 so as to effectively radiate the heat generated from each LED. That is, as shown in FIG. 13, the light-emitting portion 12 is provided so as to adhere to the inner portion of the protrusion portion 11*e* using the inner portion in the lamp main body 11 as the concave fitting portion 11*e*1, that is, the inner bottom surface of the concave fitting portion 11*e*1. As mentioned above the light-emitting portion includes the substrate 12*b* made of aluminum and a plurality of LEDs 12*a* mounted on the substrate, and the rear side of the substrate 12*b* is fixed to the inner bottom surface of the concave fitting portion 11*e*1 so as to adhere thereto via the electric insulation sheet.

Furthermore, the control device 13 is divided into a lighting circuit substrate 13*a*1 constituting the lighting circuit 13*a*, and a control circuit board 13*b*1 constituting the control circuit 13*b* performing the control of dimming or the like, and is constituted by a circuit board forming the respective circuit boards 13*a*1 and 13*b*1 in a semi-circular ring shape. The respective ring-shaped circuit boards 13*a*1 and 13*b*1 are installed in the main body situated on the inner surface side of the annular support step portion 11*d* of the lamp main body 11 (FIG. 13(*b*)). In addition, the respective circuit boards 13*a*1 and 13*b*1 are installed so as to form electric insulation with the main body case 11 formed of aluminum.

As shown by an alternate long and short dash line in FIG. 13(*a*), when lighting the lamp with the cap 10 configured as above, the light emitted from each LED 12*a* is uniformly emitted toward the inner surface of the cover member 16 as mentioned above without being shielded by the electronic component 13*c* mounted on the respective circuit boards 13*a*1 and 13*b*1. Furthermore, the heat generated from the LED 12*a* is directly transmitted from the back of the substrate 12*b* to the outer surface of the protrusion portion 11*e* of the main body case 11, that is, the thermal conduction surface 11*g*, without passing through the side wall or the like of the main body case, and it is possible to effectively radiate the heat from the thermal radiator 34 of the luminaire side to the outside. As a result, it is possible to employ the LED of high luminance and high output.

Figure 14A:
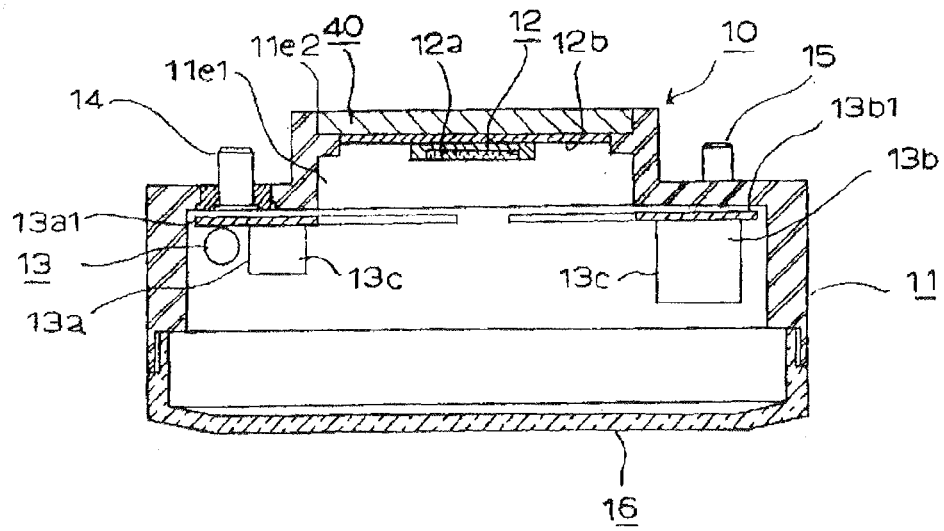
FIG. 14 shows a modified example of the lamp with the cap, FIG. 14(*a*) is a cross-sectional view showing a second modified example corresponding to FIG. 1(*b*), and FIG. 14(*b*) is a cross-sectional view showing a third modified example corresponding to FIG. 1(*b*).
Figure 14B:
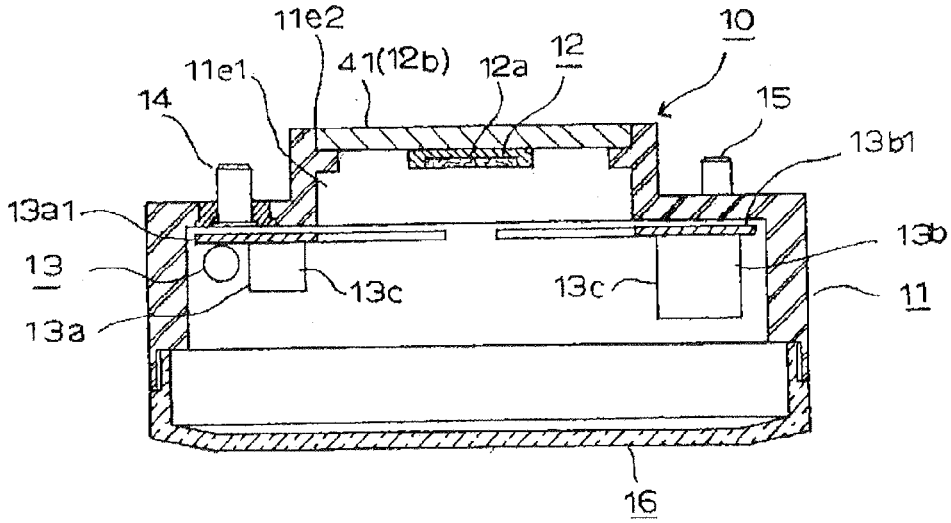

Furthermore, as shown in FIG. 14(*a*), the main body case 11 is formed of a synthetic resin, an opening portion 11*e*2 is formed by opening the bottom surface of the protrusion portion 11*e*, the disk-like thermal radiator 40 formed of a metal having satisfactory thermal conductivity, in the present embodiment, aluminum is fitted into the opening 11*e*2, and similarly to above, the light-emitting portion 12 adheres and is fixed to the thermal radiator 40. According to the configuration, the electric insulation measures of the lamp can be further promoted, and the heat generated from the LED can be effectively radiated.

Moreover, as shown in FIG. 14(*b*), the disk-like thermal radiator 41 fitted to the opening portion 11*e*2 may be constituted by the substrate 12*b* itself on which the LED 12*a* is mounted. According to this, the substrate 12*b* of the LED can directly adhere to the thermal radiator 34 of the luminaire, thermal radiation can be more effectively performed, and it is possible to employ the LED of high luminance and high output.

Furthermore, the thermal radiator 34 of the luminaire 30 and the thermal conduction surface 11*g* of the lamp main body 11 may be configured so that the thermal radiator 34 and the thermal conduction surface 11*g* adhere to each other by allowing the thermal conduction surface 11*g* of the lamp main body 11 to elastically and vertically slide with respect to the inner and outer portion of the cylindrical protrusion portion 11*e* not by the elasticity of the spring 21*b*3 in the support member 21*b* of the socket main body 21.

Furthermore, in order to increase the thermal radiation properties of the light-emitting portion and the control device, the lamp main body is preferably formed of a metal having satisfactory thermal conductivity, for example, a metal including at least one kind of aluminum (Al), copper (Cu), iron (Fe), or nickel (Ni). However, the lamp main body may be formed of an industrial material such as ceramic including aluminum nitride (AlN) or the like, and silicon carbide (SiC). Moreover, the lamp main body may be formed of a synthetic resin such as high thermal conductive resin. The external shape thereof is preferably configured so that a plane forms a substantially circular dish shape so as to achieve a thin, flat lamp with a cap, but the plane may be a polygonal shape such as a triangle, a quadrangle, or a hexagon, or may be an oval shape or the like. Furthermore, in order to further increase the thermal radiation properties, on the outer peripheral surface of the lamp main body, a plurality of thermal radiation fins, thermal radiation pins or the like projected radially may be integrally formed. Moreover, the outer surface portion exposed to the outside may be formed, for example, in a concave and convex shape or a crepe shape to increase the surface area, or a white painting and a white alumite processing may be performed to increase the thermal radiation ratio of the outer surface portion. Furthermore, in a case of performing the white painting and the white alumite processing, when mounting the lamp with the cap to the luminaire to light the lamp, the reflectance of the outer surface of the lamp main body exposed to the outer surface is increased, the luminaire efficiency can be increased, it is also advantageous in terms of the external form and the design, and the marketability can be increased.

The light-emitting portion is preferably constituted by a solid state light-emitting device which uses a light-emitting diode, a semiconductor laser, an organic EL or the like as a light-emitting source. However, the light-emitting portion may be constituted by a discharge lamp such as a fluorescent light in which a light-emitting tube meanders and is formed in a planar shape. The light-emitting portion is preferably constituted so as to emit white light, but red, blue, green or the like or various colors may be combined and constituted depending on the application of the luminaire. Furthermore, in order to constitute a surface module, the shape of the light-emitting portion may be a plate-like circular shape, and a polygonal shape such as a triangle, a quadrangle or a hexagon, or an oval shape or the like, and any shape for obtaining the optical distribution properties to be targeted is allowed.

The control device performs lighting, light-out and dimming, but may be configured so as to perform toning. In the case of performing toning, toning may be performed by integrating, for example, the LED of the bulb color and the LED of the daylight color as the LED, and switching them.

The socket device may be an independent socket device which can mount the lamp with the cap to the single socket device to constitute the luminaire, for example, like the spot light, and may be a luminaire integration type socket device like a down light in which the socket device is attached to the luminaire main body and the reflection plate and the lamp with the cap is mounted on the socket device integrated in the luminaire to constitute the luminaire.

The socket device is formed of a synthetic resin, but may be formed of a metal having satisfactory thermal conductivity so as to further increase the thermal radiation properties of the light-emitting portion and the control device, for example, a metal including at least a kind of aluminum (Al), copper (Cu), iron (Fe) or nickel (Ni), or an industrial material such as ceramic formed of aluminum nitride (AlN) or silicon carbide (SiC). The external shape thereof is preferably configured so that a plane forms a substantially circular dish shape so as to achieve a thin, flat lamp with a cap, but the plane may be a polygonal shape such as a triangle, a quadrangle, or a hexagon, or may be an oval shape or the like.

The engaging means, which mounts the lamp with the cap and the socket device in an attachable and detachable manner, forms the engaging protrusion in the lamp with the cap and forms the engaging groove in the socket device. However, on the contrary, the engaging groove may be formed in the lamp with the cap, and the engaging protrusion may be formed in the socket device.

The cap member of the lamp with the cap and the terminal member of the socket device are situated and provided on both sides with the engaging means interposed therebetween. However, the cap member for earth and the terminal member for earth may be provided by the use of space in which the cap member and the terminal member are not provided. Furthermore, an earth pin having an elastic body can be provided in a substantially central portion of the thermal conduction surface 11*g* of the protrusion portion 11*e* of the lamp main body 11, repulsive force of the elastic body is generated as contact force of the earth pin relative to the thermal radiator 34 of the luminaire side in the mounting state of the lamp main body 11 to the socket main body 21, and durability and continuity of the earth connection may be secured.

Figure 15A:
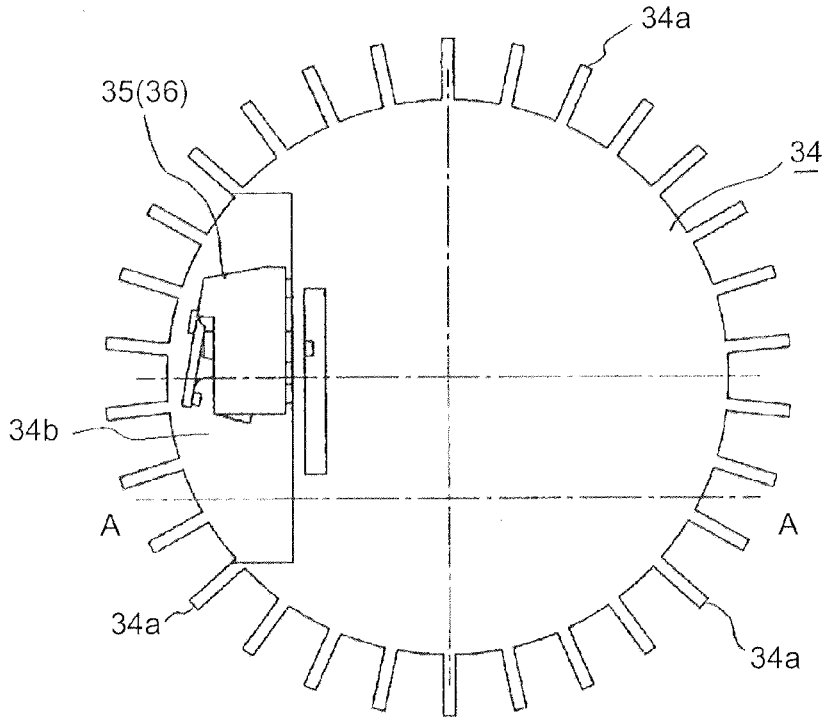
FIG. 15 shows a modified example of the luminaire, FIG. 15(*a*) is a top view, and FIG. 15(*b*) is a cross-sectional view along line A-A of FIG. 15(*a*).
Figure 15B:
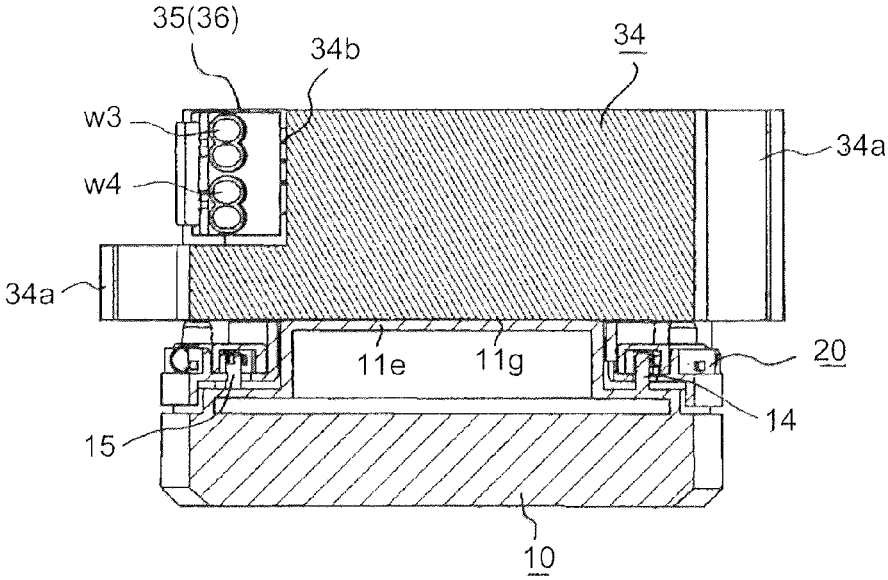

As shown in FIG. 15, the luminaire 30 may be configured so that the thermal radiator 34 is formed of a metal having satisfactory thermal conductivity, in the present embodiment, thick, disk-shaped, aluminum and a plurality of thermal radiation fins 34*a* projected in the radial direction is integrally formed on the outer peripheral surface thereof. Furthermore, the socket device 20 shown in FIG. 15 constitutes the luminaire 30 by mounting the lamp with the cap 10 to the single socket device 20. For example, the socket device 20 can be installed on the wall surface or the like to perform the spot-light type lighting. Furthermore, as shown in FIG. 12, a down light type luminaire may be configured in which the socket device 20 is integrated to the reflector 33.

Furthermore, as the luminaire, a ceiling embedded type, a direct attachment type, a suspension type, a wall surface attachment type or the like are allowed. A globe, a shade, a reflector or the like as a light control body may be attached to the luminaire, and the lamp with the cap, which is a light source, may be exposed. Furthermore, a plurality of lamps with caps may be disposed on the luminaire without being limited to one lamp with a cap. Moreover, a large luminaire or the like for facilities or a business such as an office may be configured.

As mentioned above, although the preferred embodiment of the present invention has been described, the present invention is able to perform various design changes within a scope not departing from the aim of the present invention, without being limited to the embodiment mentioned above.

REFERENCE SIGNS LIST

10 lamp with a cap
11 lamp main body
11*f* engaging means
11*e* protrusion portion
11*g* thermal conductor
12 light-emitting portion
13 control device
14 cap member for power source
15 cap member for signaling
20 socket device
21 socket main body
21*a*1 engaging means
22 terminal member for power source
23 terminal member for signaling
30 illuminaire
34 thermal radiator

The invention claimed is:

1. A lamp with a cap comprising:

a lamp main body which has engaging means mounted so as to be attachable to and detachable from a socket device;

a light emitting-portion which is accommodated in the lamp main body;

a control device which is accommodated in the lamp main body and lights and controls the light-emitting portion;

a cap member for power source which is situated adjacent to one side with the engaging means interposed therebetween, is disposed in a circumferential direction of the lamp main body, and is connected to the control device;

a cap member for signaling which is situated adjacent to the other side with the engaging means interposed therebetween, is disposed in the circumferential direction of the lamp main body, and is connected to the control device; and a thermal conductor which comes into contact with a thermal radiator in the state of being mounted on the socket device.

2. The lamp with the cap according to claim 1, wherein the lamp main body has a protrusion portion which protrudes from a center thereof and is mounted on the socket device, and the thermal radiator comes into surface-contact with an end portion of the protrusion portion mounted on the socket device.

3. The lamp with the cap according to claim 2, wherein the lamp main body is formed with a substrate support portion in an opening portion of one end portion side thereof, the other end portion side thereof is formed with an annular support step portion and a cylindrical protrusion portion, and a surface formed on an outer bottom surface of the protrusion portion is a flat surface.

4. The lamp with the cap according to claim 3, wherein the engaging means is provided on an outer peripheral surface of the protrusion portion and is mounted by a rotation operation in an attachable and detachable manner.

5. The lamp with the cap according to claim 4, wherein the cap member for power source is constituted by a pair of cap pins having a shaft portion and a base portion and is situated in an annular support step portion of the lamp main body adjacent to the engaging means, a pair of shaft portions is provided so as to protrude outward from the outer bottom surface of the lamp main body, and the base portion is electrically connected to the control device.

6. The lamp with the cap according to claim 5, wherein the cap member for signaling is constituted by a pair of cap pins having a shaft portion and a base portion and is situated in an annular support step portion of the lamp main body adjacent to the engaging means, a pair of cylindrical shaft portions is provided so as to protrude outward from the outer bottom surface of the lamp main body, the base portion is electrically connected to the control device, and the cap member for power source and the cap member for signaling are separated from each other in both side directions of the engaging means at a predetermined size and are disposed on the same circular periphery of the lamp main body.

7. The lamp with the cap according to claim 1, wherein the engaging means and the cap member for power source or the cap member for signaling are disposed so as to deviate in a radial direction and the circumferential direction of the lamp main body.

8. A socket device comprising:

a socket main body which has engaging means to which a lamp with a cap is mounted in an attachable and detachable manner;

a terminal member for power source which is situated adjacent to one side with the engaging means interposed therebetween and is disposed in a circumferential direction of the socket main body, and to which the cap member for power source of the lamp with the cap is connected; and a terminal member for signaling which is situated adjacent to the other side with the engaging means interposed therebetween and is disposed in the circumferential direction of the socket main body, and to which the cap member for signaling of the lamp with the cap is connected.

9. The socket device according to claim 8, wherein the engaging means and the terminal member for power source or the terminal member for signaling are disposed so as to deviate in the circumferential direction of the socket main body.

10. The socket device according to claim 8, wherein the terminal member for power source or the terminal member for signaling has an electric wire insertion portion into which an electric wire is inserted, and a terminal piece having a contact portion formed by bending a tip portion, the cap member for power source or the cap member for signaling of the lamp with the cap comes into contact with the contact portion along with a rotating movement, and a direction, in which the electric wire is inserted, is a tangential direction of a circular periphery in which the terminal member for power source or the terminal member for signaling is disposed.

11. The socket device according to claim 8, wherein a support member, which supports the socket main body, is provided on the socket main body surface, and the support member is not situated on an extension on the electric wire extended from the terminal member for power source or the terminal member for signaling.

12. The socket device according to claim 8, wherein the socket main body has a support hole penetrated through the center portion thereof, and engaging means, to which the lamp with the cap is mounted by the rotation operation in an attachable and detachable manner, is formed on an inner peripheral surface of the support hole.

13. The socket device according to claim 12, wherein the socket main body is provided with a support member for supporting the socket main body on a rear side of the socket main body, and the support member has a cylinder forming a tubular shape, a bolt inserted into the cylinder and a spring inserted into the bolt.

14. The socket device according to claim 13, wherein the terminal member for power source and the terminal member for signaling are separated from each other with the engaging means interposed therebetween by a predetermined size, are situated adjacent to each other, and are disposed on the same circular periphery of the socket main body.

15. A luminaire comprising:

a lamp with a cap including:

a lamp main body which has engaging means mounted so as to be attachable to and detachable from a socket device;

a light emitting-portion which is accommodated in the lamp main body;

a control device which is accommodated in the lamp main body and lights and controls the light-emitting portion;

a cap member for power source which is situated adjacent to one side with the engaging means interposed therebetween, is disposed in a circumferential direction of the lamp main body, and is connected to the control device;

a cap member for signaling which is situated adjacent to the other side with the engaging means interposed therebetween, is disposed in the circumferential direction of the lamp main body, and is connected to the control device; and a thermal conductor which comes into contact with a thermal radiator in the state of being mounted on the socket device; and a socket device including:

a socket main body which has engaging means to which the lamp with the cap is mounted in an attachable and detachable manner;

a terminal member for power source which is situated adjacent to one side with the engaging means interposed therebetween and is disposed in a circumferential direction of the socket main body, and to which the cap member for power source of the lamp with the cap is connected; and a terminal member for signaling which is situated adjacent to the other side with the engaging means interposed therebetween and is disposed in the circumferential direction of the socket main body, and to which the cap member for signaling of the lamp with the cap is connected.

16. The luminaire of claim 15, wherein the lamp main body has a protrusion portion which protrudes from a center thereof and is mounted on the socket device, and the thermal radiator comes into surface-contact with an end portion of the protrusion portion mounted on the socket device.

* * * * *